US006171413B1

(12) United States Patent
Funakawa et al.

(10) Patent No.: US 6,171,413 B1
(45) Date of Patent: Jan. 9, 2001

(54) SOFT COLD-ROLLED STEEL SHEET AND METHOD FOR MAKING THE SAME

(75) Inventors: Yoshimasa Funakawa; Toru Inazumi, both of Fukuyama; Hiroshi Sawada, Kasaoka; Naoki Matsui, Fukuyama; Jun Taniai, Fukuyama; Kenichi Mitsuzuka, Fukuyama, all of (JP)

(73) Assignee: NKK Corporation, Tokyo (JP)

( * ) Notice: Under 35 U.S.C. 154(b), the term of this patent shall be extended for 0 days.

(21) Appl. No.: 09/116,290

(22) Filed: Jul. 16, 1998

(30) Foreign Application Priority Data

Jul. 28, 1997 (JP) ..... 9-215495
Sep. 24, 1997 (JP) ..... 9-258674
Jan. 21, 1998 (JP) ..... 10-009500

(51) Int. Cl.[7] ..... C22C 38/06; C22C 38/04; C21D 8/02

(52) U.S. Cl. ..... 148/330; 148/546; 148/547; 148/603

(58) Field of Search ..... 148/330, 546, 148/547, 603

(56) References Cited

U.S. PATENT DOCUMENTS 4,348,229 9/1982 Suemara et al. .

FOREIGN PATENT DOCUMENTS

3020883 * 12/1981 (DE) ..... 148/603
0 608 430 8/1994 (EP) .
0 769 565 4/1997 (EP) .
48-100314 12/1973 (JP) .
55-77910 * 6/1980 (JP) ..... 148/603
55-94446 * 7/1980 (JP) ..... 148/603
56-156720 12/1981 (JP) .
61-266556 11/1986 (JP) .
64-15327 1/1989 (JP) .
2-263932 10/1990 (JP) .
7-3332 1/1995 (JP) .
7-242995 9/1995 (JP) .
9-3550 1/1997 (JP) .

OTHER PUBLICATIONS

Patent Abstracts of Japan, vol. 18, No. 547 (C–1262), Oct. 1994, of JP 06 192745 A, Jul. 1994.
Patent Abstracts of Japan, vol. 6, No. 191 (C–127), Sep. 1982, of JP 57 104627 A, Jun. 1982.
Patent Abstracts of Japan, vol. 18, No. 578 (C–1269), Nov. 1994, of JP 06 212354 A, Aug. 1994.

* cited by examiner

*Primary Examiner*—Deborah Yee
(74) *Attorney, Agent, or Firm*—Frishauf, Holtz, Goodman, Langer & Chick, P.C.

(57) ABSTRACT

A soft cold-rolled steel sheet contains: 0.06 wt. % or less C, 0.1 wt. % or less Si, 0.5 wt. % or less Mn, 0.03 wt. % or less P, 0.03 wt. % or less S, 0.006 wt. % or less N, 0.009 wt. % or less B and the balance being Fe. The method comprises the steps of: continuously casting a steel to produce a slab; hot-rolling the slab to form a hot-rolled steel sheet; cold-rolling the hot-rolled steel sheet to produce a cold-rolled steel sheet; and continuously annealing the cold-rolled steel sheet.

20 Claims, 6 Drawing Sheets

SOFT COLD-ROLLED STEEL SHEET AND METHOD FOR MAKING THE SAME

BACKGROUND OF THE INVENTION

1. Field of the Invention

The present invention relates to a soft cold-rolled steel sheet and a method for making the same.

2. Description of the Related Arts

In conventional production of cold-rolled steel sheets for working which are produced by continuous annealing, high-temperature coiling has been performed in the hot rolling in order to prompt precipitation of AlN and coarsening of carbides and thus to achieve softening and high r-values. High-temperature coiling, however, causes an increased scale thickness at both ends of the coil by oxygen which is readily supplied, and thus causes deterioration of acid pickling characteristics. As a method for decreasing a coiling temperature using softening by boron addition, unexamined Japanese Patent Publication No. 2-263932 discloses a method for making a cold-rolled steel sheet for deep drawing, in which a boron containing steel having a specified Mn/S ratio is heated to 1,000° C. to 1,200° C., coiled at 560° C. to 650° C., and continuously annealed at a relatively high temperature of 730° C. to 880° C. Various methods using excellent grain growth characteristics of boron containing steels have been proposed for achieving excellent workability by high-temperature continuous annealing after low-temperature coiling. For example, unexamined Japanese Patent Publication No. 7-3332 discloses a method for making a cold-rolled steel sheet for working which is characterized in that a boron containing steel sheet is coiled at 600° C. to 700° C., and annealed at 740° C. to 930° C. Unexamined Japanese Patent Publication No. 9-3550 discloses a method for making a cold-rolled steel sheet for working which is characterized in that a boron containing steel sheet is coiled at 630° C. to 720° C. and annealed at 800° C. to 880° C. Also, unexamined Japanese Patent Publication No. 56-156720 discloses a method for making a cold-rolled steel sheet having excellent workability in which the relationship between B and N is specified and high-temperature annealing is performed after low-temperature coiling at 650° C. or less. Among methods which specify the B/N ratio, added elements, and/or the heating temperature of the slab in order to achieve more excellent workability, unexamined Japanese Patent Publication No. 64-15327 discloses a method which specifies the heating temperature of the steel slab containing B in an amount of higher than the equivalent of N, that is, coiling at 550° C. to 700° C. and annealing at 750° C. to 850° C.; and unexamined Japanese Patent Publication No. 61-266556 discloses a cold-rolled steel sheet having excellent press workability in which a steel containing 0.10 to 0.30% of Cr and having a B/N ratio in a specified range from 0.5 to 2.0 is coiled at 550° C. to 700° C. and annealed at approximately 800° C.

When a boron containing steel having excellent grain growth characteristics is annealed at a high temperature of 700° C. or more, a mixed grain texture will often form and thus surface quality will deteriorate during the working. In recent years, high-quality surface characteristics have been increasingly required. Deterioration of surface characteristics due to the mixed grain texture, which was out of consideration, is raising problems; however, the above-mentioned conventional technology do not teach a countermeasure against the decreased surface quality due to the mixed grain texture formed by annealing at 700° C. or more.

As described above, there has not been a method for enhancing stability of the texture in a B containing steel during continuous annealing in order to prevent the formation of a mixed grain texture.

Thin steel sheets used in automobiles and home electric products require high formability, and achievement of softening and a high r-value is in intensive progress. When such a thin steel sheet having high formability is made by continuous annealing using a low-carbon aluminum-killed steel, C and N must be fixed as coarse precipitates by high-temperature coiling in hot rolling. Since the ends of the coil in the longitudinal direction (the T section: the top section of the coil, and the B section: the tail section of the coil) and the ends in the width direction have high cooling rates by direct contact with air even in the high-temperature coiling, AlN does not sufficiently precipitate. Since the unprecipitated AlN finely precipitates in continuous annealing, the ends in the longitudinal and width directions are hardened compared with the central section of the coil, resulting in so-called coil end characteristics. The high-temperature coiling also causes decreased acid pickling characteristics due to an increased scale thickness. As a method for solving such coil end characteristics and acid pickling characteristics, unexamined Japanese Patent Publication No. 48-100314 discloses a method for reducing the coiling temperature by the addition of B which react with N to form coarse BN and thus suppress the formation of fine AlN.

As described in unexamined Japanese Patent Publication No. 48-100314, improvement in the coil end characteristics is uniformly achieved by the addition of B, but a problem that the material quality varies arises.

In the conventional technology, the steel is hardened with an increased O content in the steel, and the material quality may vary even at the same O content in some cases.

In conventional production of cold-rolled steel sheets for working which are produced by continuous annealing, high-temperature coiling has been performed in the hot rolling in order to prompt precipitation of AlN and coarsening of carbides and thus to achieve softening and high r-values. High-temperature coiling, however, causes an increased scale thickness at both ends of the coil by oxygen which is readily supplied, and thus causes deterioration of acid pickling characteristics. Unexamined Japanese Patent Publication No. 48-100314 discloses a method for lowering the coiling temperature by fixing N with B as BN; however, application of this method to hot direct rolling does not cause effects by the lowered coiling temperature. In the heating furnace, a part of coarse MnS that precipitates in the slab is not solved. In contrast, in hot direct rolling, the rolling is performed in the state that MnS is entirely dissolved, hence fine MnS, which precipitates during the rolling, suppresses crystal grain growth.

For the purpose of obtaining a soft material by hot direct rolling having substantially the same quality as that by the heating furnace, unexamined Japanese Patent Publication No. 7-242995 discloses a method for softening by controlling the S content to 0.004% or less so as to reduce the fine MnS content. Unexamined Japanese Patent Publication No. 9-3550 discloses a method for prompting coarsening of the precipitate, in which a continuously cast slab is subjected to rolling before cooling to the $Ar_3$ point or less so as to suppress the transformation of MnS, as nuclei of the precipitate, affected by the transformation of Fe before the rolling.

When the S content is reduced to 0.004% or less by the method disclosed in unexamined Japanese Patent Publication No. 7-242995, desulfurization costs are significantly high and thus the use is limited to high class steel sheets.

In the method disclosed in unexamined Japanese Patent Publication No. 9-3550, softening is not sufficiently performed and high-temperature annealing at 800° C. or more is inevitable.

As described above, a method enabling low-temperature coiling in the hot direct rolling is now not developed when a soft cold-rolled steel sheet is produced.

SUMMARY OF THE INVENTION

It is an object of the present invention to provide a soft cold-rolled steel sheet suitable for forming automobiles and home electric products, and a method for making the same.

First, to attain the object, the present invention provides a soft cold-rolled steel sheet consisting essentially of:

0.06 wt. % or less C, 0.1 wt. % or less Si, 0.5 wt. % or less Mn, 0.03 wt. % or less P, 0.03 wt. % or less S, 0.006 wt. % or less N, 0.009 wt. % or less B, stoichiometric ratio of B/N being 0.6 to 1.5, Al satisfying the following equation:

$$Al \leqq 0.035 \times (B/N \times 0.6)^{1/2}$$

the balance being Fe and inevitable impurities.

The C content is preferably 0.01 to 0.04 wt. %, more preferably 0.01 to 0.03 wt. %. The N content is preferably 0.005 wt. % or less, more preferably 0.0035 wt. % or less.

It is preferable that the soft cold-rolled steel sheet further contains at least one element selected from the group consisting of 0.5 wt. % or less Cu, 0.5 wt. % or less Ni, 0.5 wt. % or less Cr, 0.5 wt. % or less Sn, 0.1 wt. % or less Ca, and 0.05 wt. % or less O. The at least one element is desirably 2 wt. % or less.

Secondly, the present invention provides a method for making a soft cold-rolled steel sheet comprising the steps of:

(a) providing a slab consisting essentially of:

0.06 wt. % or less C, 0.1 wt. % or less Si, 0.5 wt. % or less Mn, 0.03 wt. % or less P, 0.03 wt. % or less S, 0.006 wt. % or less N, 0.009 wt. % or less B, stoichiometric ratio of B/N being 0.6 to 1.5, Al satisfying the following equation:

$$Al \leqq 0.035 \times (B/N \times 0.6)^{1/2}$$

the balance being Fe and inevitable impurities;

(b) hot-rolling the slab at a finishing temperature of an $Ar_3$ point or more and at a coiling temperature of 650° C. or less to produce a hot-rolled steel sheet;

(c) cold-rolling the hot-rolled steel sheet to produce a cold-rolled steel sheet; and (d) continuously annealing the cold-rolled steel sheet at a heating rate of 1° C./sec. or more and at an soaking temperature of 700° C. or more.

Thirdly, the present invention provides a soft cold-rolled steel sheet consisting essentially of:

0.06 wt. % or less C, 0.5 wt. % or less Mn, 0.1 wt. % or less Si, 0.025 wt. % or less P, 0.03 wt. % or less S, 0.1 wt. % or less sol. Al, 0.005 wt. % or less O, 0.006 wt. % or less N, 0.009 wt. % or less B, atomic ratio of B/N being 0.5 to 2, aluminum oxide of 0.1 $\mu$m or less being 20 ppm or less, the balance being Fe and inevitable impurities.

The O content is preferably 0.003 wt. % or less. The aluminum oxide is preferably 10 ppm or less.

Fourthly, the present invention provides a method for making a soft cold-rolled steel sheet comprising the steps of:

(a) providing a steel consisting essentially of:

0.06 wt. % or less C, 0.5 wt. % or less Mn. 0.1 wt. % or less Si, 0.025 wt. % or less P, 0.03 wt. % or less S, 0.1 wt. % or less sol. Al, 0.005 wt. % or less O, 0.006 wt. % or less N, 0.009 wt. % or less B, atomic ratio of B/N being 0.5 to 2, aluminum oxide of 0.1 $\mu$m or less being 20 ppm or less, the balance being Fe and inevitable impurities;

(b) hot-rolling the steel at a coiling temperature of less than 650° C. to produce a hot-rolled steel sheet;

(c) pickling the hot-rolled steel sheet;

(d) cold-rolling the pickled hot-rolled steel sheet to produce a cold-rolled steel sheet; and (e) continuously annealing the cold-rolled steel sheet.

Fifthly, the present invention provides a soft cold-rolled steel sheet consisting essentially of:

0.06 wt. % or less C, 0.1 wt. % or less Si, 0.5 wt. % or less Mn, 0.03 wt. % or less P, 0.02 wt. % or less S, 0.04 wt. % or less sol. Al, 0.006 wt. % or less N, said N satisfying the following equation: N wt. %≧S wt. %/5, B being within a range defined by the following equation:

$$11/14 \times N\ \% - 0.0004 \leqq B \leqq 11/14 \times N\ \% + 0.002$$

and the balance being Fe and inevitable impurities.

Sixthly, the present invention provides a method for making a soft cold-rolled steel sheet comprising the steps of:

(a) casting a steel consisting essentially of:

0.06 wt. % or less C, 0.1 wt. % or less Si, 0.5 wt. % or less Mn, 0.03 wt. % or less P, 0.02 wt. % or less S, 0.04 wt. % or less sol. Al, 0.006 wt. % or less N, said N satisfying the following equation: N wt. %≧S wt. %/5, B being within a range defined by the following equation:

$$11/14 \times N\ \% - 0.0004 \leqq B \leqq 11/14 \times N\ \% + 0.002$$

and the balance being Fe and inevitable impurities;

(b) hot-direct rolling the steel to produce a hot-rolled steel sheet, said hot-hot direct rolling having a finishing temperature of $Ar_3$ point or more and a coiling temperature of 650° C. or less;

(c) pickling the hot-rolled steel sheet;

(d) cold-rolling the pickled hot-rolled steel sheet to produce a cold-rolled steel sheet; and (e) continuously annealing the cold-rolled steel sheet at a temperature of less than 800° C.

The step (b) of hot-direct rolling preferably comprises:

rough-rolling the steel at a finish temperature of 1000° C. or less to produce a rough-rolled steel sheet;

heating the rough-rolled steel sheet to a temperature of 1030° C. or more; and finish-rolling the heated steel sheet at a finish temperature of $Ar_3$ or more.

DESCRIPTION OF THE EMBODIMENT

Embodiment 1

Figure 1:
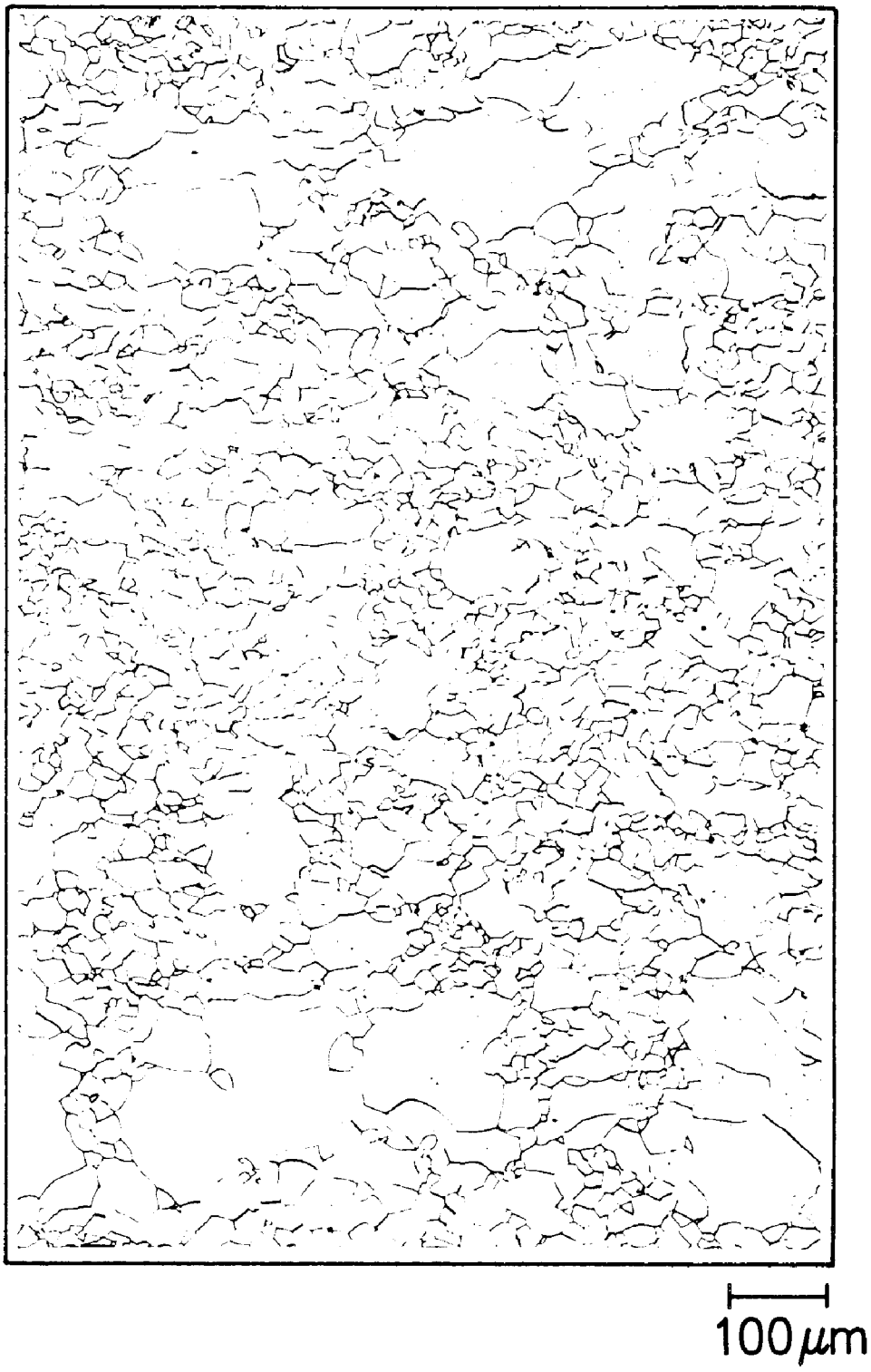
FIG. 1 is a microscopic photograph of a cross-sectional texture of a B-containing steel in which coarse ferrite grains partly form by high-temperature annealing.

A soft cold-rolled steel sheet of Embodiment 1 consists essentially of:

0.06 wt. % or less C, 0.1 wt. % or less Si, 0.5 wt. % or less Mn, 0.03 wt. % or less P, 0.03 wt. % or less S, 0.006 wt. % or less N, 0.009 wt. % or less B, stoichiometric ratio of B/N being 0.6 to 1.5, Al satisfying the following equation:

$$Al \leqq 0.035 \times (B/N \times 0.6)^{1/2}$$

the balance being Fe and inevitable impurities.

The C content is preferably 0.01 to 0.04 wt. %, more preferably 0.01 to 0.03 wt. %. The N content is preferably 0.005 wt. % or less, more preferably 0.0035 wt. % or less.

It is preferable that the soft cold-rolled steel sheet further contains at least one element selected from the group consisting of 0.5 wt. % or less Cu, 0.5 wt. % or less Ni, 0.5 wt. % or less Cr, 0.5 wt. % or less Sn, 0.1 wt. % or less Ca, and 0.05 wt. % or less O. The at least one element is desirably 2 wt. % or less.

A method for making a soft cold-rolled steel sheet according to Embodiment 1 comprises the steps of:

(a) providing a slab consisting essentially of:

0.06 wt. % or less C, 0.1 wt. % or less Si, 0.5 wt. % or less Mn, 0.03 wt. % or less P, 0.03 wt. % or less S, 0.006 wt. % or less N, 0.009 wt. % or less B, stoichiometric ratio of B/N being 0.6 to 1.5, Al satisfying the following equation:

$$Al \leqq 0.035 \times (B/N \times 0.6)^{1/2}$$

the balance being Fe and inevitable impurities;

(b) hot-rolling the slab at a finishing temperature of an $Ar_3$ point or more and at a coiling temperature of 650° C. or less to produce a hot-rolled steel sheet;

(c) cold-rolling the hot-rolled steel sheet to produce a cold-rolled steel sheet; and (d) continuously annealing the cold-rolled steel sheet at a heating rate of 1° C./sec. or more and at an soaking temperature of 700° C. or more.

The present inventors have repeated intensive study in order to achieve a boron-containing soft cold-rolled steel sheet having excellent texture stability during high-temperature annealing and a method for making the same, and results in the following knowledge.

Since the boron-containing steel has excellent grain growth characteristics, high-temperature annealing readily causes a mixed grain texture. As an example is shown in FIG. 1, coarse ferrite grains partially form when a steel containing 0.015% of C, 0.023% of Al, 0.0007% of B, and 0.0020% of N, and having a B/N ratio of 0.45 is coiled at 600° C. and annealed at 800° C.

The present inventors have repeated intensive study on the reason of the formation of such a mixed grain texture during high-temperature annealing. As a result, they have discovered that high-temperature annealing in a state that dissolved N remains to some extent causes inhomogeneous precipitation of AlN and the local formation of coarse grains in boron-containing steel having excellent grain growth characteristics. It has also been discovered that in order to suppress the mixed grain texture, the B/N ratio is specified so as to reduce the dissolved N content in the hot-rolled steel sheet, and the Al content is reduced in cooperation with the B/N ratio based on the relationship represented by the following equation (1):

$$Al \leqq 0.35 \times (B/N \times 0.6)^{1/2}$$

so as to delay the initiation of precipitation of AlN during annealing. Accordingly, it has been discovered that a soft cold-rolled steel sheet having excellent texture stability can be produced without inhibiting locally grain growth in the recrystallization process during high-temperature annealing.

Figure 2:
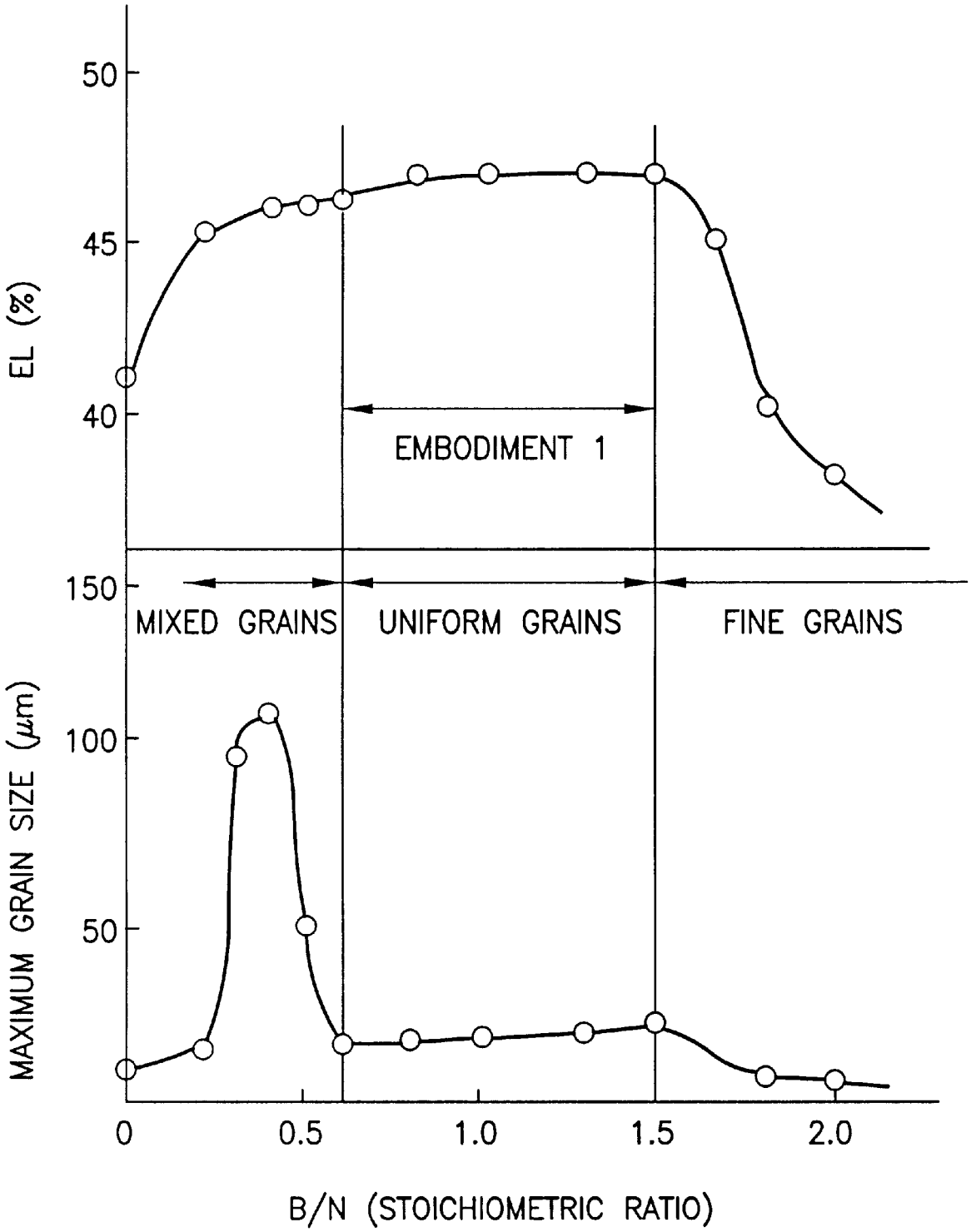
FIG. 2 is a graph illustrating the relationship between the B/N ratio and the elongation (EL) and between the B/N ratio and the maximum grain size in Embodiment 1.
Figure 3:
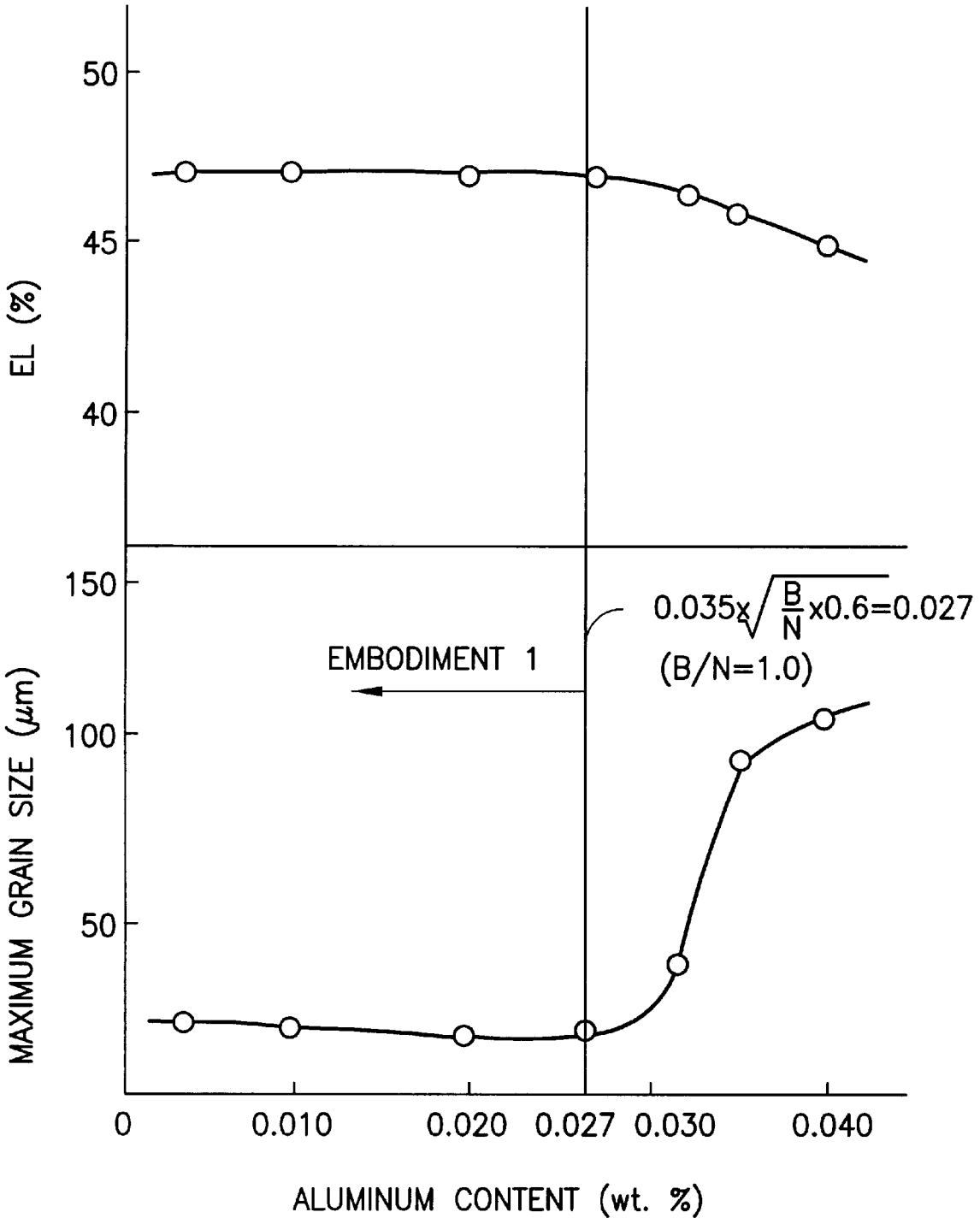
FIG. 3 is a graph illustrating the relationship between the Al content and the elongation (EL) and between the Al content and the maximum grain size in Embodiment 1.
Figure 4:
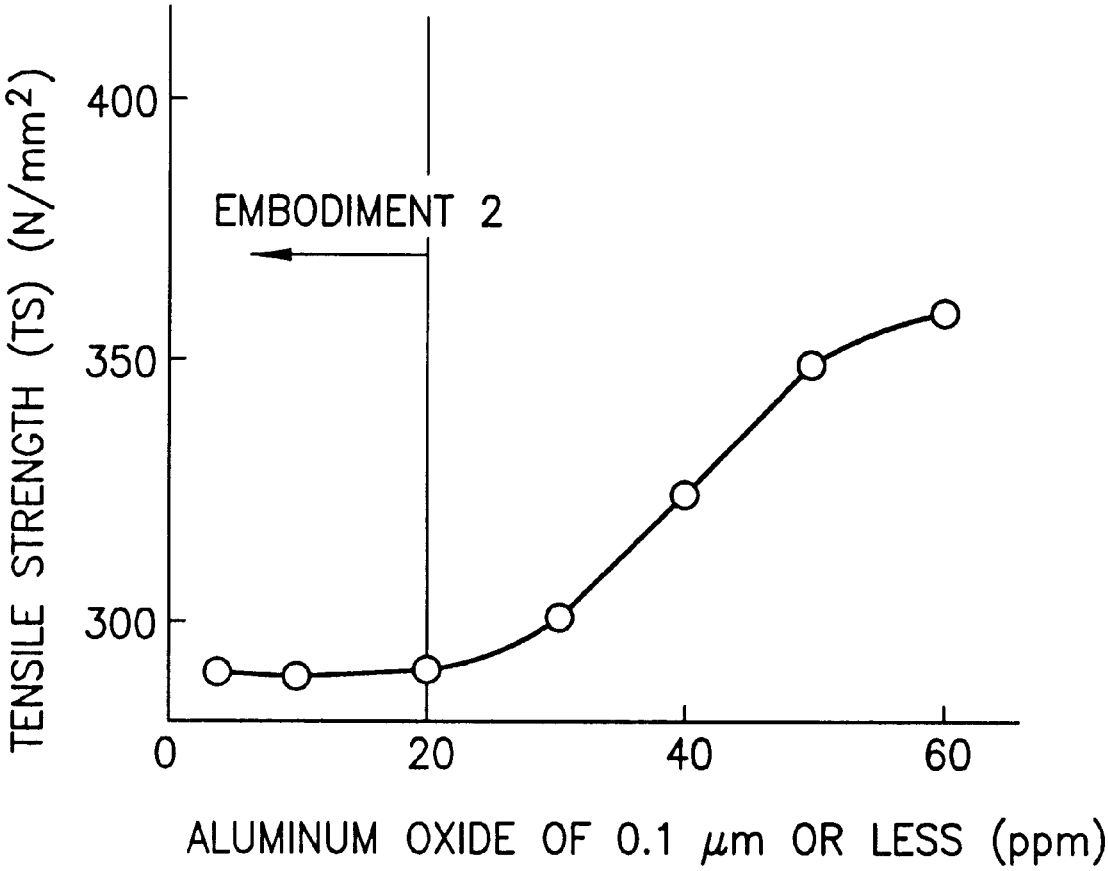
FIG. 4 is a graph illustrating the relationship between the aluminum oxide content in the steel and the tensile strength (TS) in accordance with Embodiment 2

The experiments that conducted the knowledge will now described. Materials containing approximately 0.015% of C, approximately 0.20% of Mn, approximately 0.011% of P, approximately 0.008% of S, approximately 0.010% of Al, 0.0035% or less of B, and 0.0035% or less of N and having different B/N ratios were heated to 1,200° C., finish-rolled at a temperature of the $Ar_3$ point or more, and coiled at 600° C. After acid pickling and cold rolling, they were heated at a rate of 20° C./sec. and annealed at 800° C. to prepare annealed sheets having a thickness of 1.2 mm. These were used for observation of the cross-sectional texture and for measurement of elongation (EL) using JIS No. 5 tensile test pieces. The results are shown in FIG. 2. Elongation slightly increases as the B/N ratio increases, and a softening effect is observed as conventionally described. At a B/N ratio of 0.2 or more, however, a significant softening effect is not observed. Nevertheless, the maximum grain size (the average of grain sizes of the top ten within a range of the thickness by 1 mm) significantly increases within a range of the B/N ratio of 0.2 to 0.6, and mixed grains form instead of the normal grain growth. When the B/N ratio is more than 1.5, elongation decreased due to the fine grain effect and the solid-solution strengthening caused by dissolved B. Next, materials containing approximately 0.015% of C, approximately 0.20% of Mn, approximately 0.011% of P, and approximately 0.008% of S, and having the B/N ratio of approximately 1 and different Al contents were heated to 1,200° C., finish-rolled at a temperature of the $Ar_3$ point or more, and coiled at 600° C. After acid pickling and cold rolling, they were heated at a rate of 20° C./sec. and annealed at 800° C. to prepare annealed plates having a thickness of 1.2 mm. These were used for observation of the cross-sectional texture and for measurement of elongation (EL) using JIS No. 5 tensile test pieces. The results are shown in FIG. 3. Although elongation moderately changes with a change in the Al content, the maximum grain size steeply increases for an Al content (0.027%) higher than that calculated by the equation (1) and thus the formation of a mixed grain texture is suggested.

Based on the knowledge, the present inventors discovered a boron-containing soft cold-rolled steel sheet having excellent texture stability during high-temperature annealing and a method for making the same by controlling the B/N ratio and the Al content to given levels in the B-containing steel, and by optimizing the hot-rolling and annealing conditions.

Bases of added components, limitation of the contents, and limitation of the production conditions will now be described.

(1) Chemical Composition

C≦0.06%

When more than 0.06% of C is added, large amounts of carbides precipitate, the r-value and elongation are decreased, and formability is inhibited. Thus, the upper limit is 0.06%. At less than 0.01%, the driving force for precipitation of carbides during overaging in the continuous annealing process is reduced, and overaging resistance deteriorates. Thus, the lower limit is preferably 0.01%. The C content is preferably 0.01 to 0.04 wt. %, more preferably 0.01 to 0.03 wt. %.

Si≦0.1%

When Si is excessively added, the strength increases and the formability deteriorates. Thus, the content is 0.1% or less.

Mn≦0.5%

It is preferable that the Mn content be 0.05% or more since it fixes S to form MnS, however, an excessive content causes hardening of the steel and deterioration of the formability. Thus, the upper limit is 0.5%.

P≦0.03%

P is a solid-solution strengthening element, and a content of more than 0.03% causes hardening of the steel. Thus, the upper limit is 0.03%.

S≦0.03%

Since S is an element inhibiting hot ductility and formability, it is fixed as MnS. Thus, it is preferable that the content be low. A content of higher than 0.03% causes an increased Mn content and decreased formability. Thus, the upper limit is 0.03%.

N≦0.006%

N is fixed as BN; however, a large amount of BN causes decreased workability. Thus, the upper limit is 0.0035%.

B≦0.009%

Although B is an element effective for softening, an excessive B content causes increased deformation resistance. Thus, the upper limit is 0.009%.

B/N Ratio: 0.6 to 1.5

The B/N ratio is significantly important. At a B/N ratio of less than 0.6, a large amount of fine AlN precipitates, resulting in hardening of the steel, hence the lower limit of the B/N ratio is 0.6. At a B/N ratio of higher than 1.5, B in the steel forms, resulting in hardening of the steel, hence the upper limit of the B/N ratio is 1.5.

$$\text{sol. Al} \leqq 0.035 \times (B/N \times 0.6)^{1/2} \quad (1)$$

Since Al is used as a deoxidiser, it is contained in a certain amount; however, it affects the initiation time of precipitation of fine AlN during annealing in Embodiment 1. Thus, the content range is important. Although a large amount of Al has been added for the purpose of perfect fixing of N, the Al content must be reduced in Embodiment 1. The precipitation of AlN during annealing depends on the Al content and the dissolved N content. The precipitation of AlN is first initiated in un-recrystallized portions having a large driving force. When the dissolved N content is moderately low as in B-containing steel, N is consumed for precipitation of the un-recrystallized portions. Thus, it barely precipitates in the other portions, resulting in inhomogeneous precipitation. Although recrystallization and grain growth are suppressed in the portion in which AlN precipitates, the grain growth proceeds in the other portions. Since the resulting difference in the grain size is further prompted in the growing process, a mixed grain texture is formed. In contrast, the precipitation of AlN is delayed in the un-recrystallized portions by specifying the Al content as described in the equation (1), and thus the formation of the mixed grains is suppressed.

In Embodiment 1, the steel sheet may contain 2% or less in total of at least one selected from the group consisting of 0.5% or less of Cu, 0.5% or less of Ni, 0.5% or less of Cr, 0.5% or less of Sn, 0.1% or less of Ca, and 0.05% or less of O.

Since Cu, Ni, Cr, Sn, Ca and O do not inhibit the texture stability, these can be added in adequate amounts based on the same concept as general steels. That is, Cu, Ni, Cr, and Sn having the above contents prompt aggregation of carbides and improve aging resistance. Ca prompts aggregation of carbides when it is added in an amount within the rage. O is present as oxides in the steel, functions as nuclei for MnS and BN precipitation, and prompts the precipitation.

By controlling the contents of the components as described above, a B-containing soft cold-rolled steel sheet having excellent texture stability during high-temperature annealing can be obtained.

The steel sheet having such a characteristic can be produced by the following method.

(2) Step of Producing Steel Sheet (Making Method)

A steel having a composition within the above-described range was prepared by melting, and a slab prepared by continuous casting was finish-rolled at a temperature region of the $Ar_3$ point or higher and coiled at less than 650° C. The coiled hot-rolled steel sheet was cold-rolled and continuously annealed at a heating rate of 1° C./min. or more and at an soaking temperature of 700° C. or more.

In the present invention, the temperatures of individual steps have important significance, and the effects in the present invention deteriorates if any one of these lacks.

A. Finishing Temperature

The finishing temperature is the $Ar_3$ point or more. A finishing temperature of less than the $Ar_3$ point causes the growth of the texture that causes a decreased r-value, hence the lower limit is the $Ar_3$ point.

B. Coiling Temperature

The upper limit of the coiling temperature is 650° C. in view of acid pickling characteristics; however, the shape of the coil is not stabilized at less than 200° C., hence it is preferred that the temperature be 200° C. or more.

C. Heating Rate for Annealing

In Embodiment 1, the heating rate is important. In Embodiment 1, the Al content and the B/N ratio are specified to delay the precipitation of AlN relative to recrystallization. At a heating rate of less than 1° C./sec., AlN readily precipitates, and AlN precipitates in the un-recrystallized portions before completion of the recrystallization and partially suppresses the recrystallization and crystal grain growth. Thus, the resulting texture includes mixed grains. Accordingly, the lower limit of the heating rate is 1° C./sec, more preferably 10° C./sec.

D. Annealing Temperature

Since softening is not sufficiently accomplished at an annealing temperature of less than 700° C., the lower limit of the annealing temperature is 700° C. Annealing at more than 900° C. causes the formation of a random texture during the cold rolling step, hence it is preferable that the temperature be 900° C. or less.

Although the slab heating temperature is not specified, it is preferred that the temperature be 1,050° C. or more in view of rolling load and the finishing temperature. Hot direct rolling without cooling the continuous cast slab may be also employed without trouble. The advantages in Embodiment 1 do not deteriorate when finish rolling is performed while heating and holding it after rough rolling. Continuous finish rolling of jointed rough bars after rough rolling will not cause problems. The advantages in Embodiment 1 do not deteriorate when using a thin slab. In the cold rolling after acid pickling, it is preferred that the reduction rate be 30 to 90% in view of workability and in particular deep drawability. Although the conditions for temper rolling are not limited, it is preferred that the reduction rate be 2% or less, since elongation significantly decreases at a reduction rate of more than 2%.

In the composition control of the steel in accordance with Embodiment 1, either a converter or an electric furnace may be used.

EXAMPLE 1

Each steel containing chemical components shown in Table 1 was hot-rolled at a temperature of the $Ar_3$ point or more, and coiled at a coiling temperature shown in Table 2. After acid pickling and cold rolling, it was continuously annealed under the annealing conditions shown in Table 2, and then was subjected to temper rolling with a rolling reduction rate of 1.2% to form a sheet having a thickness of 0.7 mm (Examples in accordance with the present invention Nos. 1 to 4, 6 to 9, 11 to 14, 16 and 17, and Comparative Examples No. 5, 10 and 15).

The texture stability was evaluated by texture observation measuring the maximum grain size (the average of top ten crystal grains among crystal grains lying within the range of the sheet thickness by 1 mm in the cross-sectional texture). The formability was evaluated by the tensile properties using a JIS #5 tensile testing piece. The results of the evaluation are also shown in Table 2.

Table 2 demonstrates that Examples Nos. 1 to 4, 6 to 9, 11 to 14, 16 and 17 in accordance with the present invention have excellent texture stability and excellent formability.

In contrast, Comparative Example No. 5 having a B/N ratio lower than the range of the present invention, No. 10 having an Al content larger than the range of the present invention, and No. 15 by an annealing temperature lower than the range of the present invention show inferior texture stability to that in Examples in accordance with the present invention.

Accordingly, in accordance with, a steel sheet having a stabilized texture can be obtained even by a high-temperature annealing at 700° C. or more.

TABLE 1

| Condition | Chemical components (percent by weight) | | | | | | | | | |
|---|---|---|---|---|---|---|---|---|---|---|
| No. | C | Si | Mn | P | S | Al | N | B | B/N | Miscellaneous |
| 1 | 0.016 | 0.02 | 0.15 | 0.012 | 0.009 | 0.014 | 0.0020 | 0.0022 | 1.4 | — |
| 2 | 0.014 | 0.02 | 0.16 | 0.013 | 0.009 | 0.015 | 0.0018 | 0.0009 | 0.7 | — |
| 3 | 0.015 | 0.01 | 0.15 | 0.010 | 0.008 | 0.015 | 0.0018 | 0.0012 | 0.9 | — |
| 4 | 0.014 | 0.02 | 0.14 | 0.012 | 0.010 | 0.014 | 0.0015 | 0.0012 | 1.0 | — |
| 5 | 0.013 | 0.01 | 0.15 | 0.011 | 0.009 | 0.015 | 0.0015 | 0.0003 | 0.3* | — |
| 6 | 0.023 | 0.08 | 0.44 | 0.021 | 0.025 | 0.005 | 0.0019 | 0.0012 | 0.8 | — |
| 7 | 0.021 | 0.08 | 0.43 | 0.020 | 0.026 | 0.012 | 0.0028 | 0.0017 | 0.8 | — |
| 8 | 0.022 | 0.08 | 0.45 | 0.022 | 0.027 | 0.015 | 0.0021 | 0.0012 | 0.7 | — |
| 9 | 0.021 | 0.07 | 0.45 | 0.023 | 0.024 | 0.020 | 0.0023 | 0.0016 | 0.9 | — |
| 10 | 0.021 | 0.07 | 0.45 | 0.022 | 0.026 | 0.045 | 0.0025 | 0.0015 | 0.8 | — |
| 11 | 0.025 | 0.02 | 0.22 | 0.004 | 0.015 | 0.004 | 0.0026 | 0.0020 | 1.0 | Cu: 0.07, Ni: 0.03 |
| 12 | 0.045 | 0.03 | 0.20 | 0.003 | 0.015 | 0.005 | 0.0025 | 0.0019 | 1.0 | Cu: 0.1, Ni: 0.06 |
| 13 | 0.027 | 0.03 | 0.21 | 0.003 | 0.016 | 0.008 | 0.0050 | 0.0042 | 1.1 | Cr: 0.01, Ni: 0.01 |
| 14 | 0.028 | 0.02 | 0.21 | 0.004 | 0.015 | 0.007 | 0.0020 | 0.0016 | 1.0 | Cu: 0.2, Sn: 0.03 |
| 15 | 0.012 | 0.08 | 0.05 | 0.028 | 0.005 | 0.019 | 0.0020 | 0.0012 | 0.8 | — |
| 16 | 0.013 | 0.08 | 0.05 | 0.026 | 0.003 | 0.016 | 0.0022 | 0.0013 | 0.8 | — |
| 17 | 0.013 | 0.01 | 0.05 | 0.027 | 0.003 | 0.019 | 0.0020 | 0.0012 | 0.8 | — |

Remarks:
Asterisk(*) means out of the range of Embodiment 1.

TABLE 2

| | | Annealing condition | | | | | |
|---|---|---|---|---|---|---|---|
| Condition No. | Coiling temperature (° C.) | Heating rate (° C. /sec.) | Annealing temperature (° C.) | Maximum grain size (μm) | TS ($N/mm^2$) | EL (%) | Remarks |
| 1 | 580 | 12 | 820 | 18 | 289 | 46 | Example of the invention |
| 2 | 580 | 20 | 820 | 14 | 293 | 45 | Example of the invention |
| 3 | 580 | 30 | 820 | 16 | 291 | 45 | Example of the invention |
| 4 | 580 | 50 | 820 | 16 | 290 | 46 | Example of the invention |
| 5 | 580 | 20 | 820 | 115 | 315 | 42 | Comparative Example (Mixed grain formation, low B/N ratio) |
| 6 | 600 | 35 | 800 | 20 | 302 | 44 | Example of the invention |
| 7 | 600 | 40 | 800 | 19 | 310 | 43 | Example of the invention |
| 8 | 600 | 8 | 800 | 21 | 306 | 43 | Example of the invention |
| 9 | 600 | 3 | 800 | 22 | 304 | 43 | Example of the invention |
| 10 | 600 | 30 | 800 | 130 | 306 | 41 | Comparative Example (Mixed grain formation, high Al content) |

TABLE 2-continued

| Condition No. | Coiling temperature (° C.) | Annealing condition: Heating rate (° C. /sec.) | Annealing condition: Annealing temperature (° C.) | Maximum grain size (μm) | TS (N/mm²) | EL (%) | Remarks |
|---|---|---|---|---|---|---|---|
| 11 | 550 | 200 | 840 | 15 | 321 | 41 | Example of the invention |
| 12 | 580 | 100 | 840 | 16 | 316 | 42 | Example of the invention |
| 13 | 600 | 60 | 840 | 19 | 308 | 43 | Example of the invention |
| 14 | 630 | 20 | 840 | 23 | 298 | 44 | Example of the invention |
| 15 | 620 | 0.5 | 800 | 108 | 315 | 42 | Comparative Example (Mixed grain formation, low heating rate) |
| 16 | 620 | 20 | 820 | 15 | 297 | 44 | Example of the invention |
| 17 | 620 | 60 | 850 | 16 | 281 | 47 | Example of the invention |

Remarks:
Asterisk(*) means out of the range of Embodiment 1.

EXAMPLE 2

Each steel containing chemical components shown in Table 3, which had been just produced, was hot-rolled without cooling at a temperature of the $Ar_3$ point or higher. After acid pickling and cold rolling, it was continuously annealed at an annealing temperature shown in Table 4, and then subjected to temper rolling with a rolling reduction rate of 0.8% to form a sheet having a thickness of 1.6 mm. (Examples in accordance with Embodiment 1 Nos. 1 to 4, 6 to 9, 11 to 14, 16 and 17, and Comparative Examples Nos. 5, 10 and 15).

The texture stability was evaluated by texture observation measuring the maximum grain size (the average of top ten crystal grains among crystal grains lying within the range of the sheet thickness by 1 mm in the cross-sectional texture). The formability was evaluated by the tensile properties using a JIS #5 tensile testing piece. The results of the evaluation are also shown in Table 4.

Table 4 demonstrates that Examples Nos. 1 to 4, 6 to 9, 11 to 14, 16 and 17 in accordance with Embodiment 1 have excellent texture stability and excellent formability.

In contrast, Comparative Example No. 5 having a B/N ratio higher than the range of the present invention, No. 10 having an Al content larger than the range of the present invention, and No. 15 by an annealing temperature lower than the range of the present invention show inferior texture stability to that in Examples in accordance with the present invention.

Accordingly, in accordance with, a steel sheet having a stabilized texture can be obtained even by a high-temperature annealing at 700° C. or more.

TABLE 3

| Condition No. | Chemical components (percent by weight): C | Si | Mn | P | S | Sol. Al | N | B | B/N | Miscellaneous |
|---|---|---|---|---|---|---|---|---|---|---|
| 1 | 0.010 | 0.01 | 0.08 | 0.013 | 0.008 | 0.015 | 0.0018 | 0.0009 | 0.7 | — |
| 2 | 0.011 | 0.02 | 0.07 | 0.015 | 0.008 | 0.014 | 0.0022 | 0.0015 | 0.9 | — |
| 3 | 0.012 | 0.02 | 0.08 | 0.014 | 0.007 | 0.015 | 0.0026 | 0.0024 | 1.2 | — |
| 4 | 0.012 | 0.02 | 0.06 | 0.013 | 0.007 | 0.015 | 0.0012 | 0.0013 | 1.4 | — |
| 5 | 0.012 | 0.01 | 0.07 | 0.014 | 0.008 | 0.015 | 0.0018 | 0.0040* | 2.9* | — |
| 6 | 0.019 | 0.01 | 0.40 | 0.018 | 0.025 | 0.003 | 0.0013 | 0.0010 | 1.0 | — |
| 7 | 0.020 | 0.01 | 0.35 | 0.017 | 0.026 | 0.010 | 0.0019 | 0.0015 | 1.0 | — |
| 8 | 0.020 | 0.01 | 0.39 | 0.017 | 0.026 | 0.019 | 0.0026 | 0.0020 | 1.0 | — |
| 9 | 0.021 | 0.01 | 0.42 | 0.016 | 0.023 | 0.025 | 0.0020 | 0.0016 | 1.0 | — |
| 10 | 0.019 | 0.01 | 0.39 | 0.016 | 0.024 | 0.050* | 0.0023 | 0.0018 | 1.0 | — |
| 11 | 0.023 | 0.05 | 0.18 | 0.008 | 0.011 | 0.022 | 0.0026 | 0.0026 | 1.3 | O: 0.008 |
| 12 | 0.024 | 0.06 | 0.17 | 0.009 | 0.010 | 0.023 | 0.0023 | 0.0023 | 1.3 | Ca: 0.08 |
| 13 | 0.024 | 0.06 | 0.18 | 0.009 | 0.012 | 0.023 | 0.0021 | 0.0019 | 1.2 | O: 0.03, Ca: 0.01 |
| 14 | 0.025 | 0.07 | 0.15 | 0.010 | 0.010 | 0.025 | 0.0019 | 0.0017 | 1.2 | Cu: 0.2, Ni: 0.1 |
| 15 | 0.027 | 0.04 | 0.12 | 0.027 | 0.009 | 0.018 | 0.0023 | 0.0014 | 0.8 | — |
| 16 | 0.026 | 0.03 | 0.11 | 0.023 | 0.004 | 0.017 | 0.0015 | 0.0009 | 0.8 | — |
| 17 | 0.027 | 0.03 | 0.13 | 0.021 | 0.006 | 0.019 | 0.0016 | 0.0010 | 0.8 | — |

Remarks:
Asterisk(*) means out of the range of Embodiment 1.

TABLE 4

| Condition No. | Coiling temperature (° C.) | Annealing condition: Heating rate (° C. /sec.) | Annealing condition: Annealing temperature (° C.) | Maximum grain size (μm) | TS (N/mm²) | EL (%) | Remarks |
|---|---|---|---|---|---|---|---|
| 1 | 560 | 30 | 850 | 12 | 285 | 43 | Example of the invention |
| 2 | 560 | 60 | 850 | 14 | 284 | 43 | Example of the invention |
| 3 | 560 | 250 | 850 | 15 | 291 | 42 | Example of the invention |
| 4 | 560 | 200 | 850 | 17 | 289 | 42 | Example of the invention |
| 5 | 560 | 20 | 850 | 9 | 356 | 37 | Comparative Example (Hardened, high B/N ratio) |
| 6 | 620 | 15 | 790 | 21 | 310 | 42 | Example of the invention |
| 7 | 620 | 13 | 790 | 19 | 308 | 43 | Example of the invention |
| 8 | 620 | 30 | 790 | 23 | 315 | 42 | Example of the invention |
| 9 | 620 | 35 | 790 | 25 | 307 | 43 | Example of the invention |
| 10 | 620 | 15 | 790 | 116 | 311 | 40 | Comparative Example (Mixed grain formation, high Al content) |
| 11 | 540 | 30 | 800 | 15 | 323 | 40 | Example of the invention |
| 12 | 600 | 20 | 800 | 17 | 318 | 41 | Example of the invention |
| 13 | 620 | 25 | 800 | 21 | 312 | 42 | Example of tha invention |
| 14 | 640 | 30 | 800 | 23 | 306 | 43 | Example of the invention |
| 15 | 580 | 0.8* | 810 | 136 | 320 | 41 | Comparative Example (Mixed grain formation, low heating rate) |
| 16 | 580 | 30 | 830 | 13 | 312 | 42 | Example of the invention |
| 17 | 580 | 25 | 860 | 15 | 306 | 43 | Example of the invention |

Remarks:
Asterisk(*) means out of the range of Embodiment 1.

Embodiment 2

A soft cold-rolled steel sheet of Embodiment 2 consists essentially of:

0.06 wt. % or less C, 0.5 wt. % or less Mn, 0.1 wt. % or less Si, 0.025 wt. % or less P, 0.03 wt. % or less S, 0.1 wt. % or less sol. Al, 0.005 wt. % or less O, 0.006 wt. % or less N, 0.009 wt. % or less B, atomic ratio of B/N being 0.5 to 2, aluminum oxide of 0.1 μm or less being 20 ppm or less, the balance being Fe and inevitable impurities.

The O content is preferably 0.003 wt. % or less. The aluminum oxide is preferably 10 ppm or less.

A method for making a soft cold-rolled steel sheet according to Embodiment 2 comprises the steps of:

(a) providing a steel consisting essentially of:
0.06 wt. % or less C, 0.5 wt. % or less Mn, 0.1 wt. % or less Si, 0.025 wt. % or less P, 0.03 wt. % or less S, 0.1 wt. % or less sol. Al, 0.005 wt. % or less O, 0.006 wt. % or less N, 0.009 wt. % or less B, atomic ratio of B/N being 0.5 to 2, aluminum oxide of 0.1 μm or less being 20 ppm or less, the balance being Fe and inevitable impurities;

(b) hot-rolling the steel at a coiling temperature of 650° C. or less to produce a hot-rolled steel sheet;

(c) pickling the hot-rolled steel sheet;

(d) cold-rolling the pickled hot-rolled steel sheet to produce a cold-rolled steel sheet; and (e) continuously annealing the cold-rolled steel sheet.

In the conventional technology, the addition of B affects the substitution of coarse BN for fine AlN. In contrast, the present inventors have discovered that BN precipitates on fine MnS nuclei as coarse complex precipitates and has a prominent effect to suppress crystal grain growth of fine MnS.

Although there has been reported fine MnS as nuclei for precipitating BN, the present inventors have also discovered that fine aluminum oxide of 0.1 μm or less functions as nuclei for precipitating BN. Further, the present inventors have discovered that a steel showing a small softening effect by the addition of B contains a large amount of aluminum oxide, BN predominantly precipitates on aluminum oxide nuclei rather than MnS, and a large amount of MnS does not function as nuclei for precipitating BN and inhibits crystal grain growth.

Based on the finding, the present inventors have intensively studied and discovered that a reduction in the aluminum oxide content of 0.1 μm or less prompts the precipitation of BN on fine MnS nuclei and forms coarse complex precipitates of MnS such that the effects by the addition of B is stabilized. In the hot direct rolling in which hot rolling is directly performed after continuous casting, MnS is completely dissolved in the rolling process, hence the fine MnS content increases. It was also discovered that prevention of strain-induced precipitation at a high temperature causing an increased amount of dissolved MnS is effective for the reduction of the fine MnS content.

Based on the finding, the present inventors have discovered a stable method for making a soft cold-rolled steel sheet having an excellent shape in the longitudinal direction of the coil by specifying the oxygen content in the B-containing low-carbon steel to a certain level or less so that a reduction in fine aluminum oxide stabilizes the softening effects by the addition of B, and by specifying the upper limit of the coiling temperature in the hot rolling in order to maximize the effects by the addition of B so that low-temperature coiling is achieved and acid pickling characteristics are improved by reducing precipitation of AlN and enhancing crystal grain growth, and have accomplished the present invention.

Accordingly, Embodiment 2 can provide a stable method for making a soft cold-rolled steel sheet having an excellent shape in the longitudinal direction of the coil by limiting the composition and the production conditions of the steel as described above.

Bases of added components, limitation of the contents, and limitation of the production conditions in the present invention will now be described.

(1) Chemical Composition

C≦0.06%

When more than 0.06% of C is contained, large amounts of carbides precipitate, the r-value and elongation are decreased, and formability is inhibited. Thus, the upper limit is 0.06%.

Mn≦0.5%

It is preferable that the Mn content be 0.05% or more since it fixes S to form MnS, however, an excessive content causes hardening of the steel and deterioration of the formability. Thus, the upper limit is 0.5%.

Si≦0.1%

When Si is excessively added, the strength increases and the formability deteriorates. Thus, the content is 0.1% or less.

P≦0.025%

P is a solid-solution strengthening element, and an excessive content causes hardening of the steel. Thus, the upper limit is 0.025%.

S≦0.03%

Since S is an element inhibiting hot ductility and formability, it is fixed as MnS. Thus, it is preferable that the content be low. A higher MnS content causes a decreased elongation. Thus, the upper limit is 0.03%.

Sol. Al≦0.1%

Since Al is used as a deoxidiser, it is contained in a certain amount. In the present invention, the added B fixes a considerable amount of N as BN, and thus only a trace amount of AlN, which does not cause any problem, precipitates; however, an excessive Al content causes a modification of BN into AlN during annealing after cold rolling, and the resulting excess of B causes hardening of the steel. Thus, the upper limit is 0.1% .

N≦0.006%

N is fixed as BN; however, a large amount of BN causes decreased workability. Thus, the upper limit is 0.006%.

B≦0.009%, and B/N (Atomic Ratio)=0.5 to 2

Although B is an element that plays a vital role in the present invention. In Embodiment 2 in which the aluminum oxide content is restricted, B precipitates as BN on fine MnS nuclei to form coarse MnS complex precipitate and to suppress precipitation of fine AlN by fixation of N. As a result, stable crystal grain growth that has not been achieved can be achieved even in low-temperature coiling in Embodiment 2. An excessive B content, however, causes hardening because of the formation of dissolved B, hence, the upper limit of the content is 0.009%. When a large amount of B in relation to N is added, an increased dissolved B content hardens the steel. Thus, the atomic B/N ratio is 0.5 to 2. It is preferable that the atomic B/N ratio be 0.8 to 1.5 to achieve particularly stabilized material quality.

O: 0.005% or less, or 0.003% or less (for Hot direct rolling)

O in the steel is fixed by Al as $Al_2O_3$; however, a content of higher than 0.005% causes an increased aluminum oxide content and the formation of course $Al_2O_3$, resulting in deterioration of surface characteristics and material quality. Thus, the upper limit is 0.005%. Since the fine MnS content increases in the hot direct rolling, the aluminum oxide content must be further reduced. Thus, the upper limit of the O content is 0.003% for the hot direct rolling.

Aluminum oxide of 0.1 μm or less: 20 ppm or less, or 10 ppm or less (for Hot direct rolling)

The aluminum oxide content is essential for Embodiment 2. When a large amount of aluminum oxide of 0.1 μm or less forms, BN precipitates on aluminum oxide nuclei of 0.1 μm or less and thus fine MnS is not modified into course complex precipitate. Thus, the upper limit of the content of aluminum oxide of 0.1 μm or less is 20 ppm or less. In the hot direct rolling, MnS is hardly coarsened and thus the fine MnS content is increased. Thus, the upper limit for the hot direct rolling is 10 ppm. The experimental results supporting the limitation are shown below.

Steels containing approximately 0.02% of C, approximately 0.01% of Si, approximately 0.015% of P, approximately 0.01% of S, approximately 0.02% of Al, approximately 0.002% of N, approximately 0.0015% of B, and different amounts of aluminum oxide were heated to 1,250° C., and subjected to rolling at 1,200° C. They were subjected to hot rolling, that is, coiled at 600° C. after rolling. The hot-rolled sheets were subjected to acid pickling, cold rolling, and annealing at 750° C. The annealed sheets were subjected to temper rolling at a rolling reduction rate of 1.0%, and JIS #5 testing pieces were cut out and subjected to the tensile test. The results of tensile strength are shown in FIG. 2. The graph demonstrates that the softening effect by the addition of B is noticeable at an aluminum oxide content of 20 ppm or less.

The effects in the present invention do not deteriorate when Cu, Ni, Cr, Sn, Mn and Pb are added in the steel in accordance with Embodiment 2 depending on various purposes. When elements forming fine nitrides, for example, Ti, V, Nb and Zr, these fine precipitates inhibit crystal grain growth and form dissolved B, resulting in deterioration of material quality. Thus, it is preferable that the contents of these elements be 0.01% or less.

When the contents of individual components are adjusted as described, a soft cold-rolled steel sheet having an excellent shape in the longitudinal direction of the coil can be obtained in a stable state.

The steel sheet having such characteristics can be produced by the following manufacturing method.

(2) Steel Sheet Production Step (2-1) Production Conditions in Embodiment 2-1

(Manufacturing Method)

A steel having the above-mentioned composition was melted in a converter, and subjected to continuous casting to form a steel slab. The resulting steel was subjected to hot rolling while coiling at 650° C. or less, acid pickling, cold rolling and continuous annealing.

A. Coiling Temperature: 650° C. or less

The coiling temperature is essential for Embodiment 2. A high coiling temperature causes precipitation of AlN as well as BN, hence, B remains as an excessive amount of dissolved B, resulting in hardening of the steel and deterioration of acid pickling characteristics. Thus, the upper limit of the coiling temperature is 650° C. At less than 300° C., sufficient crystal grain growth does not occur after coiling and fine precipitates form in the grains, resulting in hardening. Thus, the coiling temperature is preferably 300° C. or more.

In the production conditions in Embodiment 2-1, although the initial rolling temperature is not limited, it is preferable that the initial rolling temperature be 1,300° C. or less in order to suppress fine MnS precipitate by redissolution.

(2-2) Production Conditions in Embodiment 2-2

(Manufacturing Method)

In hot direct rolling in which a steel having the above-mentioned composition was melted in a converter, and subjected to continuous casting and then hot rolling without cooling, rolling was started at a temperature of 1,220° C. or less. The resulting steel was subjected to coiling at 650° C. or less, acid pickling, cold rolling and continuous annealing.

A. Initial Rolling Temperature: 1,220° C. or less

In the hot direct rolling, the initial rolling temperature plays a vital role. In Embodiment 2, crystal grain growth is accelerated by enveloping fine MnS in BN, and thus low-temperature coiling is achieved.

The limitation of the initial rolling temperature can control the fine MnS content formed by strain induction. At an initial rolling temperature of higher than 1,220° C., fine MnS significantly precipitates by strain induction, and thus the effect by the addition of B is canceled. Accordingly, the initial rolling temperature is 1,220° C. or less.

B. Coiling Temperature: 650° C. or less

Similar to the manufacturing conditions in Embodiment 2-1.

In Embodiment 2 as described above, temperatures in individual steps are of great significance. When one of these lacks, the advantages in Embodiment 2 are not achieved.

Heating conditions are not limited, and a temperature of 1,220° C. or less will not cause any problem. Heating for homogenizing the temperature at the surface and the interior may be incorporated before rolling. The rough bar may be heated or coiled around a coil box after rough rolling in order to remove the skid mark and to hold the finishing temperature. The advantages in Embodiment 2 can be achieved when using a thin slab casting process as long as the conditions in Embodiment 2 are satisfied.

In cold rolling after acid pickling, it is preferable that the reduction rate be 30 to 90% in view of workability and particularly deep drawability. Annealing is performed at 600° C. or more for softening, and at 900° C. or less for suppressing coarse grain formation. The annealing process is a continuous annealing process. The advantages in Embodiment 2 are not affected by surface treatment, such as melting plating, electric plating, chemical treatment, and organic coating. The temper rolling conditions are not limited, however, an excessively high reduction rate causes a significant reduction in elongation. Thus, it is preferable that the reduction rate be 2% or less. The component control of the steel in accordance with the present invention may be performed in a converter or an electric furnace.

In the steel in accordance with Embodiment 2, the material quality is stabilized not only in the longitudinal direction, but also in the width direction. Also, Embodiment 2 can reduce shape defects caused by quality fluctuation in the width direction, for example, center wave caused by hardening at both edges in the width direction.

The advantages in Embodiment will now be described with reference to the following Examples.

EXAMPLE 1

Each of steels containing chemical components shown in Table 5 (Examples in accordance with Embodiment 2 Nos. 1 to 11, and Comparative Examples No. 12 to 16) was continuously cast, cooled to room temperature, inserted into a heating furnace, and hot-rolled at an initial rolling temperature and a coiling temperature shown in Table 5. The hot-rolled sheet was subjected to acid pickling, cold rolling, continuous annealing at 700° C., and then temper rolling with a rolling reduction rate of 1% to form a cold-rolled sheet. From the resulting cold-rolled sheet, JIS #5 tensile testing pieces were prepared to determine tensile strengths (TSs) in the longitudinal and width directions of the coil. The steels in the present invention Nos. 1 to 11 were soft, and the difference in TSs between the center and the edges was 30 N/mm$^2$ or less, demonstrating excellent coil end characteristics.

In contrast, the steel for comparison No. 12 having a low B/N ratio shows high coil end characteristics. The steel for comparison No. 13 by a high initial rolling temperature does not show sufficient softening effects by the addition of B. The steel for comparison No. 15 having a high oxygen content and the steel for comparison No. 16 having a high aluminum oxide content of 0.1 $\mu$m or less are hard. The steel for comparison No. 14 by a high coiling temperature is hard and shows high coil end characteristics.

TABLE 5

| Steel | Chemical components (percent by weight) | | | | | | | | | Alumina-based oxide content of 0.1 $\mu$m or | | Initial rolling temp. | Coiling temp. | TS in the center | TS at the end |
|---|---|---|---|---|---|---|---|---|---|---|---|---|---|---|---|
| No. | C | Si | Mn | P | S | Al | N | B | O | less | B/N | (° C.) | (°C.) | (N/mm$^2$) | (N/mm$^2$) |
| 1 | 0.012 | 0.01 | 0.15 | 0.012 | 0.008 | 0.021 | 0.0024 | 0.0010 | 0.0025 | 8 | 0.54 | 1200 | 620 | 328 | 345 |
| 2 | 0.012 | 0.01 | 0.16 | 0.012 | 0.009 | 0.023 | 0.0023 | 0.0015 | 0.0023 | 7 | 0.85 | 1200 | 620 | 317 | 332 |
| 3 | 0.011 | 0.01 | 0.15 | 0.011 | 0.008 | 0.022 | 0.0024 | 0.0023 | 0.0021 | 7 | 1.25 | 1200 | 620 | 310 | 314 |
| 4 | 0.012 | 0.01 | 0.15 | 0.012 | 0.008 | 0.021 | 0.0023 | 0.0027 | 0.0022 | 8 | 1.53 | 1200 | 620 | 321 | 323 |
| 5 | 0.012 | 0.02 | 0.15 | 0.011 | 0.007 | 0.023 | 0.0025 | 0.0037 | 0.0023 | 8 | 1.92 | 1200 | 620 | 330 | 336 |
| 6 | 0.021 | 0.05 | 0.23 | 0.020 | 0.025 | 0.087 | 0.0015 | 0.0012 | 0.0043 | 2 | 1.04 | 1190 | 520 | 338 | 340 |
| 7 | 0.023 | 0.04 | 0.25 | 0.019 | 0.023 | 0.076 | 0.0018 | 0.0013 | 0.0039 | 2 | 0.94 | 1190 | 580 | 331 | 346 |
| 8 | 0.022 | 0.05 | 0.24 | 0.021 | 0.024 | 0.081 | 0.0019 | 0.0014 | 0.0039 | 2 | 0.96 | 1190 | 640 | 323 | 333 |
| 9 | 0.018 | 0.02 | 0.38 | 0.008 | 0.016 | 0.045 | 0.0028 | 0.0030 | 0.0016 | 14 | 1.39 | 1210 | 600 | 318 | 320 |
| 10 | 0.018 | 0.01 | 0.39 | 0.007 | 0.014 | 0.045 | 0.0027 | 0.0029 | 0.0016 | 14 | 1.40 | 1210 | 600 | 316 | 319 |
| 11 | 0.019 | 0.02 | 0.38 | 0.006 | 0.015 | 0.048 | 0.0028 | 0.0028 | 0.0017 | 14 | 1.30 | 1210 | 600 | 320 | 324 |
| 12 | 0.020 | 0.03 | 0.25 | 0.016 | 0.007 | 0.056 | 0.0026 | 0.0005 | 0.0021 | 3 | 0.25* | 1190 | 630 | 363 | 398 |
| 13 | 0.019 | 0.03 | 0.23 | 0.016 | 0.007 | 0.055 | 0.0025 | 0.0020 | 0.0023 | 3 | 1.04 | 1350* | 630 | 361 | 363 |
| 14 | 0.022 | 0.04 | 0.24 | 0.015 | 0.008 | 0.054 | 0.0024 | 0.0020 | 0.0020 | 3 | 1.08 | 1210 | 680* | 362 | 328 |
| 15 | 0.020 | 0.05 | 0.25 | 0.016 | 0.009 | 0.053 | 0.0026 | 0.0022 | 0.0068* | 3 | 1.10 | 1200 | 630 | 351 | 353 |
| 16 | 0.012 | 0.01 | 0.15 | 0.01 | 0.01 | 0.02 | 0.0022 | 0.0009 | 0.0023 | 35* | 0.53 | 1200 | 620 | 371 | 370 |

Remarks:
Asterisk(*) means out of the range of the present invention.

EXAMPLE 2

Each of steels containing chemical components shown in Table 6 (Examples in accordance with Embodiment 2 Nos. 1 to 11, and Comparative Examples No. 12 to 15) was continuously cast, and then subjected to hot direct rolling with an initial rolling temperature and a coiling temperature shown in Table 6 without cooling. The hot-rolled sheet was subjected to acid pickling, cold rolling, continuous annealing at 750° C., and then temper rolling with a rolling reduction rate of 0.8% to form a cold-rolled sheet. From the resulting cold-rolled sheet, JIS #5 tensile testing pieces were prepared to determine tensile strengths (TSs) in the center and at the position of 25 mm from the edge in the width direction in the central portion in the longitudinal direction of the coil. The steels in the present invention Nos. 1 to 11 were soft, and the difference in TSs between the center and the edges was 30 N/mm$^2$ or less, demonstrating excellent coil end characteristics.

In contrast, the steel for comparison No. 12 having a high B content are hard. The steel for comparison No. 13 by a high initial rolling temperature does not show sufficient softening effects by the addition of B. The steel for comparison No. 15 having a high oxygen content is hard. The steel for comparison No. 14 by a high coiling temperature is hard and shows high coil end characteristics.

TABLE 6

| Steel | Chemical components (percent by weight) | | | | | | | | | | Initial rolling temperature | Coiling temperature | TS in the center | TS at the end |
|---|---|---|---|---|---|---|---|---|---|---|---|---|---|---|
| No. | C | Si | Mn | P | S | Al | N | B | O | B/N | (° C.) | (° C.) | (N/mm$^2$) | (N/mm$^2$) |
| 1 | 0.020 | 0.02 | 0.17 | 0.017 | 0.007 | 0.030 | 0.0020 | 0.0008 | 0.0025 | 0.52 | 1200 | 580 | 326 | 339 |
| 2 | 0.022 | 0.02 | 0.18 | 0.017 | 0.007 | 0.029 | 0.0023 | 0.0017 | 0.0022 | 0.96 | 1190 | 580 | 315 | 332 |
| 3 | 0.021 | 0.02 | 0.18 | 0.017 | 0.006 | 0.031 | 0.0019 | 0.0021 | 0.0021 | 1.44 | 1180 | 580 | 318 | 320 |
| 4 | 0.023 | 0.02 | 0.17 | 0.017 | 0.007 | 0.030 | 0.0022 | 0.0029 | 0.0020 | 1.71 | 1190 | 580 | 330 | 331 |
| 5 | 0.021 | 0.02 | 0.18 | 0.017 | 0.008 | 0.029 | 0.0021 | 0.0032 | 0.0019 | 1.98 | 1190 | 580 | 339 | 340 |
| 6 | 0.045 | 0.07 | 0.29 | 0.010 | 0.015 | 0.041 | 0.0015 | 0.0010 | 0.0025 | 0.87 | 1160 | 560 | 346 | 360 |
| 7 | 0.044 | 0.07 | 0.28 | 0.010 | 0.015 | 0.040 | 0.0016 | 0.0007 | 0.0028 | 0.57 | 1170 | 620 | 339 | 350 |
| 8 | 0.046 | 0.07 | 0.29 | 0.010 | 0.016 | 0.039 | 0.0018 | 0.0009 | 0.0027 | 0.65 | 1180 | 640 | 328 | 342 |
| 9 | 0.013 | 0.01 | 0.41 | 0.022 | 0.021 | 0.020 | 0.0025 | 0.0035 | 0.0019 | 1.82 | 1190 | 600 | 326 | 326 |
| 10 | 0.013 | 0.01 | 0.41 | 0.022 | 0.021 | 0.019 | 0.0026 | 0.0038 | 0.0018 | 1.90 | 1130 | 600 | 316 | 316 |
| 11 | 0.013 | 0.01 | 0.42 | 0.022 | 0.021 | 0.018 | 0.0028 | 0.0040 | 0.0018 | 1.86 | 1100 | 600 | 320 | 322 |
| 12 | 0.030 | 0.05 | 0.21 | 0.012 | 0.008 | 0.030 | 0.0022 | 0.0054* | 0.0025 | 3.19* | 1190 | 600 | 372 | 374 |
| 13 | 0.032 | 0.05 | 0.21 | 0.012 | 0.008 | 0.065 | 0.0019 | 0.0020 | 0.0026 | 1.37 | 1250* | 600 | 354 | 358 |
| 14 | 0.033 | 0.05 | 0.22 | 0.012 | 0.009 | 0.020 | 0.0020 | 0.0023 | 0.0027 | 1.50 | 1200 | 700* | 357 | 324 |
| 15 | 0.030 | 0.05 | 0.23 | 0.012 | 0.010 | 0.067 | 0.0018 | 0.0021 | 0.0075 | 1.52 | 1210 | 600 | 362 | 363 |

Remarks:
Asterisk(*) means out of the range of the present invention.

Embodiment 3

A soft cold-rolled steel sheet of Embodiment 3 consists essentially of:

0.06 wt. % or less C, 0.1 wt. % or less Si, 0.5 wt. % or less Mn, 0.03 wt. % or less P, 0.02 wt. % or less S, 0.04 wt. % or less sol. Al, 0.006 wt. % or less N, said N satisfying the following equation: N wt. %≧S wt. %/5, B being within a range defined by the following equation:

$$11/14\times N\ \%-0.0004\leqq B\leqq 11/14\times N\ \%+0.002$$

and the balance being Fe and inevitable impurities.

A method for making a soft cold-rolled steel sheet according to Embodiment 3 comprises the steps of:

(a) casting a steel consisting essentially of:

0.06 wt. % or less C, 0.1 wt. % or less Si, 0.5 wt. % or less Mn, 0.03 wt. % or less P, 0.02 wt. % or less S, 0.04 wt. % or less sol. Al, 0.006 wt. % or less N, said N satisfying the following equation: N wt. %≧S wt. % /5, B being within a range defined by the following equation:

$$11/14\times N\ \%-0.0004\leqq B\leqq 11/14\times N\ \%+0.002$$

and the balance being Fe and inevitable impurities;

(b) hot-hot direct rolling the steel to produce a hot-rolled steel sheet, said hot-hot direct rolling having a finishing temperature of $Ar_3$ point or more and a coiling temperature of 650° C. or less;

(c) pickling the hot-rolled steel sheet;

(d) cold-rolling the pickled hot-rolled steel sheet to produce a cold-rolled steel sheet; and (e) continuously annealing the cold-rolled steel sheet at a temperature of less than 800° C.

The step (b) of hot-hot direct rolling preferably comprises:

rough-rolling the steel at a finish temperature of 1000° C. or less to produce a rough-rolled steel sheet;

heating the rough-rolled steel sheet to a temperature of 1030° C. or more; and finish-rolling the heated steel sheet at a finish temperature of $Ar_3$ or more.

Conventionally, reduction of the S content to 0.004% or less has been generally performed to reduce the fine MnS content. The present inventors have repeated intensive study of a method for softening a B-containing steel which contains 0.005% or more of S even in hot direct rolling, and discovered the conditions for entirely precipitating a large amount of fine MnS forming during the hot direct rolling together with BN so that the entire precipitate are coarsened. That is, N is added depending to the S content such that S/5≦N and B is added in relation to N. Although the reason is not clarified, it is presumed as follows. Since MnS that precipitates during the hot direct rolling more easily becomes precipitation nuclei than MnS formed by rolling a heating furnace material, fine MnS entirely forms a complex precipitate with BN by adding an optimum amount of N to the S content. Thus, softening to the same level as that of the heating furnace material can be achieved by hot direct rolling. When rough rolling and finish rolling are separately performed, the rough rolling is completed at 1,000 or less so as to form a supercooling state of MnS and then heated to 1,030° C. or more to entirely precipitate MnS as nuclei for BN before finish rolling. This enhances the effects.

Based on the finding, the present inventors discovered a method for making a soft cold-rolled steel sheet by hot direct rolling permitting low-temperature coiling of the steel sheet having substantially the same quality as that of the heating furnace material, by specifying the N content to the S content in a B-containing steel, controlling the B content to a certain range in response to the N content, by specifying the finishing temperature in the hot direct rolling, and by specifying the final temperature of rough rolling and the heating temperature of the rough bar when the rough rolling is employed.

Embodiment 3 can provide, by limiting the composition and the production conditions of the steel to the above-mentioned ranges, a soft cold-rolled steel sheet having excellent workability and a method for making the soft cold-rolled steel sheet having substantially the same quality as that of a heating furnace material, which permits low-temperature coiling even when it is produced by hot direct rolling.

Bases of added components, limitation of the contents, and limitation of the production conditions in Embodiment 3 will now be described.

(1) Chemical Composition

C≦0.06%

When more than 0.06% of C is added, large amounts of carbides precipitate, the r-value and elongation are decreased, and formability is inhibited. Thus, the C content is 0.06% or less. At less than 0.01%, the driving force for precipitation of carbides during overaging in the continuous annealing process is reduced, and overaging resistance deteriorates. Thus, the content of 0.01% or higher is preferred.

Si≦0.1%

When Si is excessively added, the strength increases and the formability deteriorates. Thus, the content is 0.1% or less.

Mn≦0.5%

It is preferable that the Mn content be 0.05% or more since it fixes S to form MnS that improves hot ductility, however, an excessive content causes hardening of the steel and deterioration of the formability. Thus, the upper limit is 0.5%.

P≦0.03%

P is a solid-solution strengthening element, and a content of higher than 0.03% causes hardening of the steel. Thus, the upper limit is 0.03%.

S≦0.02%

Since S is an element inhibiting hot ductility and formability, it is fixed as MnS. A content of higher than 0.02% causes an increased Mn content and decreased formability. Thus, the upper limit is 0.02%. Since a reduction of the S content to 0.004% or less causes large amounts of steel manufacturing costs, it is preferred that the lower limit be 0.005%.

Sol. Al≦0.04%

Since Al is used as a deoxidiser, it is contained in a certain amount. Al precipitates as AlN to suppress precipitation of BN and to inhibit coarsening of fine MnS. precipitation of fine AlN. Thus, the content is 0.1% or less.

N≦0.006%, and N %≦S %/5

N is fixed as BN; however, at a small amount of BN, that is, a N content of 0.001% or less, fine MnS is not entirely coarsened and the softening effect in Embodiment 3 is not achieved. Thus, the lower limit is preferably 0.001%. On the other hand, an excessive amount of N causes deterioration of workability because of the formation of a large amount of BN, hence, the upper limit is set to 0.006%. It is preferable that the upper limit be 0.004%. The reason for adding N so as to satisfy N≧S/5 will be described based on the experimental results.

Figure 5:
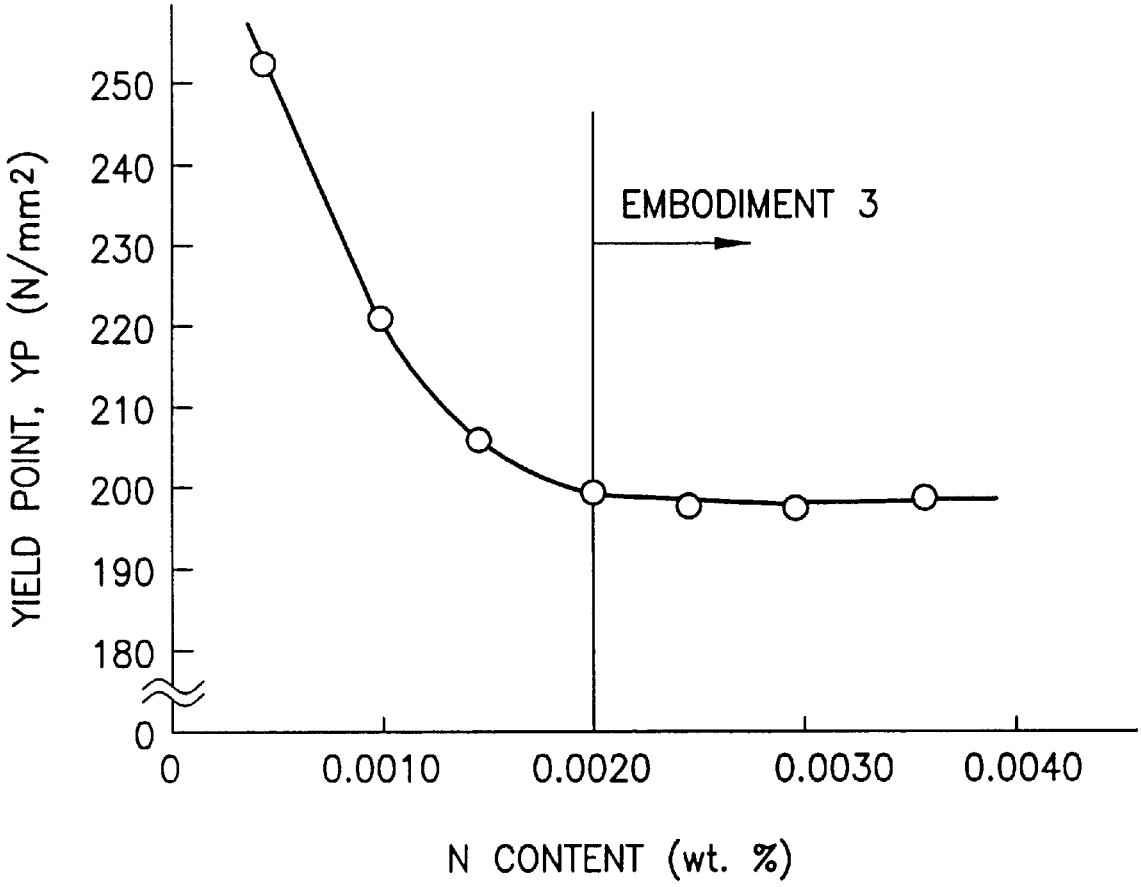
FIG. 5 is a graph illustrating the relationship between the N content and the yield point (YP) of an annealed sheet in Embodiment 3.

Steels containing approximately 0.02% of C, approximately 0.01% of Si, approximately 0.2% of Mn, approximately 0.015% of P, approximately 0.01% of S, approximately 0.02% of Al, different amounts of N, and B in an amount satisfying B/N=approximately 1 were prepared by casting and subjected to hot direct rolling at a finishing temperature of 870° C. and a coiling temperature of 630° C. The steel sheets were subjected to acid pickling, cold rolling, continuous annealing, and temper annealing to produce annealed sheets having a thickness of 0.8 mm. Annealing temperature was 720° C. From the resulting annealed sheets, JIS #5 testing pieces were cut out and subjected to the tensile test. The yield point (YP) to the N content was plotted in FIG. 5. The YP decreases as the N content increases and is saturated at N %≧S %/5. Thus, the N content for achieving the softening effect of the present invention satisfies N %≧S %/5.

$$B: 11/14\times N\ \%-0.0004 \leqq B \leqq 11/14\times N\ \%+0.002$$

B reacting with N to form coarse BN is an element effective for softening. When B is added so as to satisfy 11/14×N %−0.0004≦B≦11/14×N %+0.002 in response to the N content, MnS can entirely combine with BN. On the other hand, a B content of higher than 11/14×N %+0.002 causes hardening by dissolved B. Thus, the upper limit is 11/14×N %+0.002.

The reason for determining the B content as described above will be described based on the experimental results.

Figure 6:
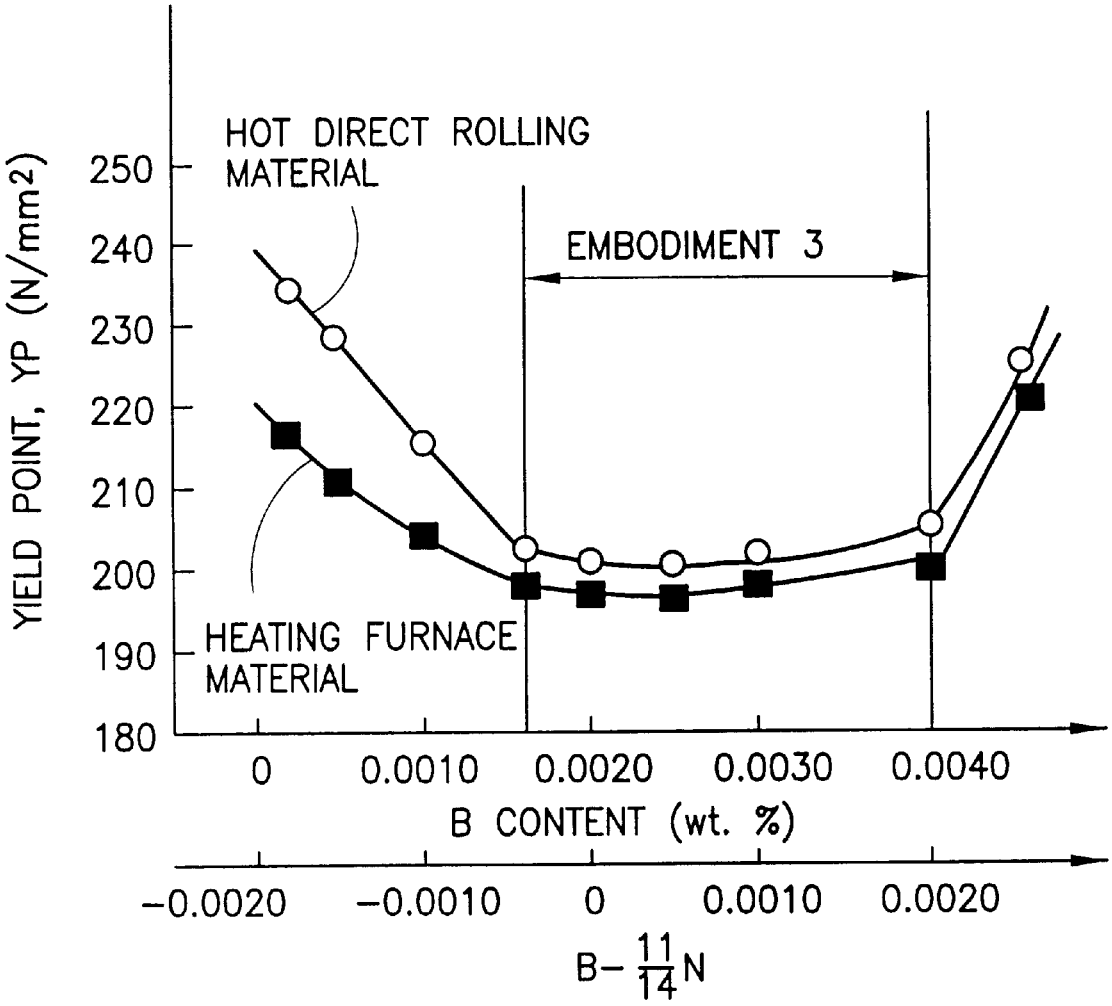
FIG. 6 is a graph illustrating a change in the yield point (YP) with a change in the B content of a hot direct rolling material and a heating furnace material in Embodiment 3.

Steels containing approximately 0.020% of C, approximately 0.01% of Si, approximately 0.20% of Mn, approximately 0.015% of P, approximately 0.010% of S, approximately 0.020% of Al, approximately 0.0025% of N, and different amounts of B were prepared by casting and subjected to hot direct rolling at a finishing temperature of 870° C. and a coiling temperature of 600° C. Steels which were heated at 1,250° C. in a furnace were also rolled as above for comparison. The steel sheets were subjected to acid pickling, cold rolling, continuous annealing, and temper annealing to produce annealed sheets having a thickness of 0.8 mm. Annealing temperature was 750° C. From the resulting annealed sheets, JIS #5 testing pieces were cut out and subjected to the tensile test. FIG. 6 shows changes in the yield point (YP) with the B content of the hot direct rolling materials and the furnace heating materials. The YP of the hot direct rolling material approaches that of the heating furnace material as the B content increases. There is no difference between the hot direct rolling material and the furnace heating material when 0.0016% of B is added (corresponding to B=11/14×N %−0.0004 for N=0.0025%), and the difference is maintained when B is further added. On the other hand, the YPs of the hot direct rolling material and the furnace heating material steeply increases (that is, hardening by dissolved B occurs) when more than 0.004% of B is added (corresponding to B=11/14×N %+0.002 for N=0.0025%), and thus the softening effect of Embodiment 3 is not achieved. Thus, the B content satisfies 11/14×N %−0.0004≦B≦11/14×N %+0.002.

When rough rolling is completed at 1,000° C. or less and rough bar heating is performed at 1,050° C. or more, MnS entirely precipitates before precipitation of BN to prompt the effects by the addition of B. The difference between the hot direct rolling material and the heating furnace material is negligible when B is added in an amount of 11/14×N %−0.001 or more, hence, the lower limit of the B content is 11/14×N %−0.001.

Since Cu, Ni, Cr, Sn, Ca and O do not inhibit the softening which is intended in the present invention, these can be added in adequate amounts based on the same concept as general steels. That is, the addition of Cu, Ni, Cr, and Sn improve corrosion resistance, and the addition of Ca prompts aggregation of carbides and improves aging resistance.

O is present as oxide in the steel, functions as nuclei for precipitating MnS and BN, and prompts their precipitation. Sb and As mixed when using scrap as a melting material do not affect the advantages in Embodiment 3.

By controlling the contents of the components as described above, a soft cold-rolled steel sheet having excellent workability, a method for making the soft cold-rolled steel sheet can be achieved, in which low-temperature coiling can be employed in the hot direct rolling and the steel sheet has substantially the same quality as that by the furnace heating material.

The steel sheet having such a characteristic can be produced by the following method.

(2) Step of Producing Soft Cold-Rolled Steel Sheet

In the present invention, temperatures of the following steps has great significance, and thus the advantage in accordance with Embodiment 3 will deteriorate if any one of these lacks.

(2-1) Manufacturing Conditions in Embodiment 3-1

(Manufacturing method)

In the hot direct rolling for rolling a steel having a composition within the above-described range immediately after casting, finish rolling is completed at the $Ar_3$ point or higher, and coiling is performed at 650° C. or less to form a hot-rolled steel sheet. The steel sheet is subjected to acid pickling, cold rolling and continuous annealing at less than 800° C.

A. Finishing Temperature

In the present invention, the finishing temperature is the $Ar_3$ point or higher. A finishing temperature of less than the $Ar_3$ point causes the growth of the texture that causes a decreased r-value, hence the lower limit is the $Ar_3$ point.

B. Coiling Temperature

The upper limit of the coiling temperature is 650° C. in view of acid pickling characteristics; however, fine carbides causing a significant decrease in the r-value precipitate at less than 450° C., hence the temperature is preferably 450° C. or more, and more preferably 550° C. or more.

C. Annealing Temperature

In the present invention, high-temperature annealing is not necessary since excellent grain growth is achieved even in the hot direct rolling. Thus, annealing temperature is 800° C. or less in order to prevent decreased productivity and the formation of coarse grains caused by high-temperature annealing. Since recrystallization does not occur at a significantly low temperature, the annealing temperature is preferably 680° C. or more. Although the soaking temperature is not limited, it is preferably 60 seconds or more in order to stabilize the texture.

(2-2) Manufacturing Conditions in Embodiment 3-2

When the steel having the composition described above is subjected to hot direct rolling for performing rolling immediately after casting, rough rolling is completed at 1,000° C. or less, finish rolling is performed by heating it to 1,050° C. or more, the finish rolling is completed at the $Ar_3$ point or more, and coiling is performed at 650° C. or less. The resulting hot-rolled steel sheet is subjected to acid pickling, cold rolling, and continuous annealing at less than 800° C.

A. Final Temperature of Rough Rolling, and Heating Temperature of Rough Bar

When the rough rolling is completed at 1,000° C. or less, MnS is present in a supercooling state. When the rough bar is heated to 1,030° C. or more, MnS entirely deposits before deposition of BN, resulting in enhancement of the advantages in accordance with Embodiment 3. Since MnS insufficiently deposits at a heating temperature of the rough bar of less than 1,030° C., the lower limit of the heating temperature of the rough bar is 1,030° C. The method for heating the rough bar is not limited, and induction heating, gas heating, or tunnel furnace heating may be employed.

When the rough bars are jointed after the rough rolling, and subjected to continuous finish rolling, no trouble occurs. The advantages in accordance with the present invention are maintained when the rough rolling is omitted by using a thin slab. In this case, the rough bar heating corresponds to slab heating.

B. Finishing Temperature

The same as the manufacturing condition in Embodiment 3-1.

C. Coiling Temperature

The same as the manufacturing condition in Embodiment 3-1.

D. Annealing Temperature

The same as the manufacturing condition in Embodiment 3-1.

In the cold rolling after acid pickling, the rolling reduction rate is preferably 30% to 90% in view of workability, and in particular deep drawability. The conditions for temper rolling are not limited, however, when it is higher than 2%, EL significantly decreases. Thus, it is preferably 2% or less. A converter or an electric furnace may be used for the component control of the steel in accordance with Embodiment 3. Galvanization, tinning, and chemical conversion treatment with chromate, or zinc phosphate do not affect the advantages.

The advantages in accordance with the present invention will be proved with reference to the following Examples.

EXAMPLE 1

Each of steels containing chemical components shown in Table 7 (Examples in accordance with Embodiment 3 Nos. 3 to 8, 12 to 16, 19 to 21 and 23 to 26, and Comparative Examples No. 1, 2, 9 to 11, 17, 18, 22 and 27) was cast, and hot direct rolling was immediately performed. In the hot direct rolling, finish rolling was performed at a temperature of the $Ar_3$ point or higher, and coiling was performed at a coiling temperature (CT) shown in Table 8 (hot direct rolling material). After acid pickling, cold rolling, and continuous annealing at 795° C., temper rolling was performed at a rolling reduction rate of 0.8% to prepare a sheet having a thickness of 0.8 mm. A slab having the same charge was cooled to room temperature, heated to 1,200° C. and rolled under the same conditions (heating furnace material). Characteristics of the resulting annealed sheets were evaluated by a tensile test using JIS #5 tensile testing pieces. Table 8 shows tensile strength (TS), elongation (EL) of the hot direct rolling materials and the difference in EL between the hot direct rolling material and the furnace heating material.

The steels Nos. 1 to 9 (Examples in accordance with the present invention Nos. 3 to 8, and Comparative Examples Nos. 1, 2, and 9) have different B contents. Comparative Examples Nos. 1 and 2 having low B contents show great differences in EL from the furnace heating material. Comparative Example 9 having a high B content does not show a difference in EL from the furnace heating material, but shows significant hardening by dissolved B.

Comparative Examples Nos. 10 and 11 also having low B contents show great differences in EL from the furnace heating material. Comparative Example 17 having a high B content shows significant hardening by dissolved B.

The steels Nos. 18 to 22 (Examples in accordance with the present invention Nos. 19 to 21, and Comparative Examples Nos. 18 and 22) have different N contents. Comparative Example No. 18 having a low N content compared with the S content show great differences in EL from the furnace heating material, because a large amount of fine MnS remains without combining with BN. Comparative Example 22 having a high N content shows a low EL because a large amount of BN deposits.

In Nos. 23 to 27 (Examples in accordance with the present invention Nos. 23 to 26, and Comparative Example Nos. 27), the S content is varied. Comparative Example nos. 27 having a high S content shows a significant decrease in EL.

In Examples Nos. 3 to 8, 12 to 16, 19 to 21, and 23 to 26 satisfying the component range in accordance with the Embodiment 3 can provide excellent characteristics (TS, EL of the hot direct rolling material and a difference in EL from the furnace heating material) showing excellent workability.

As described above, the same characteristics as those of a general furnace heating material can be achieved by the hot direct rolling in accordance with Embodiment 3, and thus low-temperature coiling can be achieved.

TABLE 7

| Condition No. | Chemical components (percent by weight) | | | | | | | | | |
|---|---|---|---|---|---|---|---|---|---|---|
| | C | Si | Mn | P | S | Sol. Al | N | B | 11/14N − 0.0004 | 11/14N + 0.002 |
| 1 | 0.020 | 0.02 | 0.19 | 0.016 | 0.008 | 0.023 | 0.0022 | 0.0005* | 0.0013 | 0.0037 |
| 2 | 0.021 | 0.02 | 0.20 | 0.014 | 0.007 | 0.024 | 0.0024 | 0.0012* | 0.0015 | 0.0039 |
| 3 | 0.021 | 0.01 | 0.21 | 0.014 | 0.007 | 0.025 | 0.0023 | 0.0015 | 0.0014 | 0.0038 |
| 4 | 0.022 | 0.01 | 0.20 | 0.014 | 0.007 | 0.023 | 0.0022 | 0.0019 | 0.0013 | 0.0037 |
| 5 | 0.022 | 0.01 | 0.20 | 0.014 | 0.007 | 0.025 | 0.0023 | 0.0022 | 0.0014 | 0.0038 |
| 6 | 0.023 | 0.01 | 0.19 | 0.015 | 0.008 | 0.023 | 0.0023 | 0.0026 | 0.0014 | 0.0038 |
| 7 | 0.023 | 0.02 | 0.21 | 0.014 | 0.009 | 0.025 | 0.0025 | 0.0036 | 0.0016 | 0.0040 |
| 8 | 0.020 | 0.01 | 0.19 | 0.016 | 0.007 | 0.026 | 0.0025 | 0.0038 | 0.0016 | 0.0040 |
| 9 | 0.019 | 0.01 | 0.21 | 0.015 | 0.007 | 0.024 | 0.0025 | 0.0050* | 0.0016 | 0.0040 |
| 10 | 0.028 | 0.03 | 0.25 | 0.010 | 0.017 | 0.035 | 0.0036 | 0.0010* | 0.0024 | 0.0048 |
| 11 | 0.026 | 0.03 | 0.26 | 0.010 | 0.016 | 0.036 | 0.0037 | 0.0020 | 0.0025 | 0.0049 |
| 12 | 0.028 | 0.01 | 0.23 | 0.012 | 0.017 | 0.030 | 0.0035 | 0.0025 | 0.0024 | 0.0048 |
| 13 | 0.027 | 0.02 | 0.21 | 0.011 | 0.016 | 0.034 | 0.0036 | 0.0029 | 0.0024 | 0.0048 |
| 14 | 0.027 | 0.01 | 0.22 | 0.011 | 0.017 | 0.036 | 0.0036 | 0.0036 | 0.0024 | 0.0048 |
| 15 | 0.028 | 0.01 | 0.23 | 0.011 | 0.017 | 0.037 | 0.0033 | 0.0035 | 0.0022 | 0.0046 |
| 16 | 0.028 | 0.01 | 0.19 | 0.012 | 0.016 | 0.034 | 0.0035 | 0.0045 | 0.0024 | 0.0048 |
| 17 | 0.026 | 0.02 | 0.22 | 0.012 | 0.019 | 0.034 | 0.0036 | 0.0059* | 0.0024 | 0.0048 |
| 18 | 0.015 | 0.05 | 0.35 | 0.028 | 0.010 | 0.021 | 0.0010* | 0.0006 | 0.0004 | 0.0028 |
| 19 | 0.015 | 0.08 | 0.33 | 0.025 | 0.010 | 0.022 | 0.0015 | 0.0015 | 0.0008 | 0.0032 |
| 20 | 0.016 | 0.07 | 0.36 | 0.026 | 0.010 | 0.023 | 0.0028 | 0.0020 | 0.0018 | 0.0042 |
| 21 | 0.018 | 0.06 | 0.34 | 0.027 | 0.009 | 0.022 | 0.0035 | 0.0029 | 0.0024 | 0.0048 |
| 22 | 0.016 | 0.06 | 0.35 | 0.026 | 0.010 | 0.019 | 0.0046* | 0.0035 | 0.0032 | 0.0056 |
| 23 | 0.019 | 0.02 | 0.18 | 0.009 | 0.004 | 0.013 | 0.0035 | 0.0029 | 0.0024 | 0.0048 |
| 24 | 0.018 | 0.02 | 0.17 | 0.009 | 0.008 | 0.013 | 0.0035 | 0.0028 | 0.0024 | 0.0048 |
| 25 | 0.019 | 0.03 | 0.18 | 0.009 | 0.011 | 0.013 | 0.0035 | 0.0028 | 0.0024 | 0.0048 |
| 26 | 0.018 | 0.01 | 0.17 | 0.009 | 0.015 | 0.013 | 0.0035 | 0.0028 | 0.0024 | 0.0048 |
| 27 | 0.016 | 0.02 | 0.17 | 0.009 | 0.036* | 0.013 | 0.0035 | 0.0028 | 0.0024 | 0.0048 |

Remarks:
Asterisk(*) means out of the range of the present invention.

TABLE 8

| Condition No. | CT (° C.) | TS ($N/mm^2$) | EL (%) | EL difference from furnace material (%) | Remarks |
|---|---|---|---|---|---|
| 1 | 600 | 360 | 38.3 | 8 | Comparative Example (Low B content, hard, large EL difference) |
| 2 | 600 | 343 | 40.2 | 6 | Comparative Example (Low B content, hard, large EL difference) |
| 3 | 600 | 321 | 43.0 | 3 | Example of the invention |
| 4 | 600 | 313 | 45.2 | 2 | Example of the invention |
| 5 | 600 | 316 | 43.0 | 2 | Example of the invention |
| 6 | 600 | 318 | 43.4 | 3 | Example of the invention |
| 7 | 600 | 328 | 42.1 | 2 | Example of the invention |
| 8 | 600 | 335 | 41.2 | 3 | Example of the invention |
| 9 | 600 | 368 | 39.3 | 2 | Comparative Example (High B content, hard) |
| 10 | 580 | 373 | 37.0 | 10 | Comparative Example (Low B content, hard, large EL difference) |
| 11 | 580 | 368 | 37.5 | 7 | Comparative Example (Low B content, hard, large EL difference) |
| 12 | 580 | 340 | 40.6 | 3 | Example of the invention |

TABLE 8-continued

| Condition No. | CT (° C.) | TS (N/mm²) | EL (%) | EL difference from furnace material (%) | Remarks |
|---|---|---|---|---|---|
| 13 | 580 | 336 | 41.1 | 2 | Example of the invention |
| 14 | 580 | 335 | 41.2 | 3 | Example of the invention |
| 15 | 580 | 336 | 41.1 | 3 | Example of the invention |
| 16 | 580 | 346 | 39.9 | 2 | Example of the invention |
| 17 | 580 | 390 | 32.3 | 2 | Comparative Example (High B content, hard) |
| 18 | 640 | 350 | 39.4 | 8 | Comparative Example (Low N content, large EL difference) |
| 19 | 640 | 329 | 41.9 | 3 | Example of the invention |
| 20 | 640 | 308 | 44.8 | 2 | Example of the invention |
| 21 | 640 | 310 | 44.5 | 2 | Example of the invention |
| 22 | 640 | 313 | 34.4 | 2 | Comparative Example (High N content, low EL) |
| 23 | 620 | 368 | 37.5 | 3 | Example of the invention |
| 24 | 620 | 356 | 38.8 | 3 | Example of the invention |
| 25 | 620 | 323 | 42.7 | 3 | Example of the invention |
| 26 | 620 | 326 | 42.3 | 2 | Example of the invention |
| 27 | 620 | 328 | 30.5 | 4 | Comparative Example (High S content, low EL) |

EXAMPLE 2

Immediately after casting each of steels containing chemical components shown in Table 9 (Examples Nos. 1 to 12), hot rolling was initiated under the conditions shown in Table 10.

After rough rolling, each rough bar other than Examples Nos. 5, 9 and 12 was heated by induction heating, and the finishing temperature was set to the $Ar_3$ point or higher. After acid pickling, cold rolling and continuous annealing at 750° C., the sheet was subjected to temper rolling with a rolling reduction rate of 0.8% to prepare a sheet having a thickness of 1.0 mm. A slab having the same charge was cooled to room temperature, heated to 1,200° C. and rolled under the same conditions (heating furnace material). Characteristics of the resulting annealed sheets were evaluated by a tensile test using JIS #5 tensile testing pieces. Table 10 shows tensile strength (TS), elongation (EL) of the hot direct rolling materials and the difference in EL between the hot direct rolling material and the furnace heating material.

In Examples Nos. 1 to 5 in accordance with the present invention, the B content is varied. The comparison of Examples Nos. 1 to 4 with No. 5 demonstrates that rough bar heating prompts the effects by the present invention. In Examples Nos. 6 to 9 in accordance with the present invention, the N content is varied. The comparison of Examples Nos. 6 to 8 with No. 9 demonstrates that rough bar heating prompts the effects by the present invention. Examples Nos. 10 to 12 in accordance with the present invention having different S contents also demonstrates the effects of rough bar heating.

TABLE 9

| Condition | Chemical components (percent by weight) | | | | | | | | 11/14N − | 11114N + |
|---|---|---|---|---|---|---|---|---|---|---|
| No. | C | Si | Mn | P | S | Sol. Al | N | B | 0.0004 | 0.002 |
| 1 | 0.017 | 0.02 | 0.15 | 0.007 | 0.007 | 0.034 | 0.0017 | 0.0010 | 0.0009 | 0.0033 |
| 2 | 0.018 | 0.02 | 0.13 | 0.007 | 0.006 | 0.033 | 0.0018 | 0.0012 | 0.0010 | 0.0034 |
| 3 | 0.018 | 0.02 | 0.14 | 0.008 | 0.007 | 0.030 | 0.0016 | 0.0012 | 0.0009 | 0.0033 |
| 4 | 0.017 | 0.02 | 0.13 | 0.007 | 0.00S | 0.031 | 0.0019 | 0.0018 | 0.0011 | 0.0035 |
| 5 | 0.017 | 0.01 | 0.14 | 0.008 | 0.006 | 0.030 | 0.0018 | 0.0026 | 0.0010 | 0.0034 |
| 6 | 0.026 | 0.03 | 0.23 | 0.013 | 0.008 | 0.021 | 0.0018 | 0.0016 | 0.0010 | 0.0034 |
| 7 | 0.026 | 0.03 | 0.22 | 0.015 | 0.008 | 0.022 | 0.0023 | 0.0019 | 0.0014 | 0.0038 |
| 8 | 0.027 | 0.01 | 0.21 | 0.016 | 0.008 | 0.023 | 0.0028 | 0.0022 | 0.0018 | 0.0042 |
| 9 | 0.025 | 0.02 | 0.23 | 0.015 | 0.008 | 0.020 | 0.0036 | 0.0029 | 0.0024 | 0.0048 |
| 10 | 0.012 | 0.05 | 0.41 | 0.021 | 0.005 | 0.014 | 0.0033 | 0.0028 | 0.0022 | 0.0046 |
| 11 | 0.013 | 0.06 | 0.43 | 0.021 | 0.009 | 0.013 | 0.0032 | 0.0029 | 0.0021 | 0.0045 |
| 12 | 0.014 | 0.06 | 0.40 | 0.022 | 0.013 | 0.014 | 0.0031 | 0.0026 | 0.0020 | 0.0044 |

TABLE 10

| Condition No. | Final temperature of rough rolling (° C.) | Heating temperature of rough bar (° C.) | CT (° C.) | TS (N/mm$^2$) | EL (%) | EL difference from furnace material (%) | Remarks |
|---|---|---|---|---|---|---|---|
| 1 | 980 | 1060 | 630 | 320 | 43.1 | 0 | Example of the invention |
| 2 | 970 | 1060 | 630 | 318 | 43.4 | −1 | Example of the invention |
| 3 | 980 | 1050 | 630 | 322 | 42.9 | 0 | Example of the invention |
| 4 | 980 | 1060 | 630 | 320 | 43.1 | 1 | Example of the invention |
| 5 | Not used | Not used | 630 | 332 | 41.1 | 3 | Example of the invention |
| 6 | 960 | 1060 | 590 | 335 | 41.2 | 0 | Example of the invention |
| 7 | 960 | 1060 | 590 | 331 | 41.7 | −1 | Example of the invention |
| 8 | 970 | 1060 | 590 | 336 | 41.1 | −1 | Example of the invention |
| 9 | Not used | Not used | 590 | 341 | 40.1 | 3 | Example of the invention |
| 10 | 980 | 1070 | 620 | 316 | 43.7 | 0 | Example of the invention |
| 11 | 990 | 1070 | 620 | 315 | 43.8 | −1 | Example of the invention |
| 12 | Not used | Not used | 620 | 328 | 40.6 | 3 | Example of the invention |

What is claimed is:

1. A soft cold-rolled steel sheet consisting essentially of:

0.06 wt. % or less C, 0.1 wt. % or less Si, 0.5 wt. % or less Mn, 0.03 wt. % or less P, 0.03 wt. % or less S, 0.006 wt. % or less N, 0.009 wt. % or less B, a stoichiometric ratio of B/N being 0.6 to 1.5, Al satisfying the following equation:

$$Al \leqq 0.035 \times (B/N \times 0.6)^{1/2}$$

and the balance being Fe and inevitable impurities.

2. The soft cold-rolled steel sheet of claim 1, wherein said C is 0.01 to 0.04 wt. %.

3. The soft cold-rolled steel sheet of claim 2, wherein said C is 0.01 to 0.03 wt. %.

4. The soft cold-rolled steel sheet of claim 1, wherein said N is 0.005 wt. % or less.

5. The soft cold-rolled steel sheet of claim 4, wherein said N is 0.0035 wt. % or less.

6. The soft cold-rolled steel sheet of claim 1, further containing at least one element selected from the group consisting of 0.5 wt. % or less Cu, 0.5 wt. % or less Ni, 0.5 wt. % or less Cr, 0.5 wt. % or less Sn, 0.1 wt. % or less Ca, and 0.05 wt. % or less O, a total of said at least one element being 2 wt. % or less.

7. A method for making a soft cold-rolled sheet comprising:

(a) providing a slab consisting essentially of:

0.06 wt. % or less C, 0.1 wt. % or less Si, 0.5 wt. % or less Mn, 0.03 wt. % or less P, 0.03 wt. % or less S, 0.006 wt. % or less N, 0.009 wt. % or less B, a stoichiometric ratio of B/N being 0.6 to 1.5, Al satisfying the following equation:

$$Al \leqq 0.035 \times (B/N \times 0.6)^{1/2}$$

and the balance being Fe and inevitable impurities;

(b) hot-rolling the slab from (a) at a finishing temperature of an $Ar_3$ point or more and coiling the resultant hot-rolled steel sheet at a coiling temperature of 650° C. or less to produce a hot-rolled steel sheet;

(c) cold-rolling the hot-rolled steel sheet from (b) to produce a cold-rolled steel sheet; and (d) continuously annealing the cold-rolled steel sheet from (c) at a heating rate of 1° C./sec. or more and at a soaking temperature of 700° C. or more.

8. A soft cold-rolled steel sheet consisting essentially of:

0.06 wt. % or less C, 0.5 wt. % or less Mn, 0.1 wt. % or less Si, 0.025 wt. % or less P, 0.03 wt. % or less S, 0.1 wt. % or less sol. Al, 0.005 wt. % or less O, 0.006 wt. % or less N, 0.009 wt. % or less B, atomic ratio of B/N being 0.5 to 2, aluminum oxide of 0.1 $\mu$m or less being 20 ppm or less, the balance being Fe and inevitable impurities.

9. The soft cold-rolled steel sheet of claim 8, wherein said O is 0.003 wt. % or less.

10. The soft cold-rolled steel sheet of claim 8, wherein said aluminum oxide is 10 ppm or less.

11. A method for making a soft cold-rolled steel sheet comprising:

(a) providing a steel consisting essentially of:

0.06 wt. % or less C, 0.5 wt. % or less Mn, 0.1 wt. % or less Si, 0.025 wt. % or less P, 0.03 wt. % or less S, 0.1 wt. % or less sol.Al, 0.005 wt. % or less O, 0.006 wt. % or less N, 0.009 wt. % or less B, an atomic ratio of B/N being 0.5 to 2, aluminum oxide of 0.1 $\mu$m or less being 20 ppm or less, and the balance being Fe and inevitable impurities;

(b) hot-rolling the steel from (a) and coiling the resultant hot-rolled steel at a coiling temperature of 650° C. or less to produce a hot-rolled steel sheet;

(c) pickling the hot-rolled steel sheet from (b);

(d) cold-rolling the pickled hot-rolled steel sheet to produce a cold-rolled steel sheet from (c); and (e) continuously annealing the cold-rolled steel sheet from (d).

12. The method of claim 11, wherein the step (a) of providing the steel comprises continuously casting the steel; and the step (b) comprises hot-direct rolling the cast steel at a temperature of 1220° C. or less and coiling the resultant hot-direct rolled steel at a coiling temperature of 650° C. or less.

13. The method of claim 11, wherein said O is 0.003 wt. % or less.

14. The method of claim 11, wherein said aluminum oxide is 10 ppm or less.

15. A soft cold-rolled steel sheet consisting essentially of:

0.06 wt. % or less C, 0.1 wt. % or less Si, 0.5 wt. % or less Mn, 0.03 wt. % or less P, 0.02 wt. % or less S, 0.04 wt. % or less sol. Al, 0.006 wt. % or less N, said N satisfying the following equation: N wt. %≧S wt. %/5, B being within a range defined by the following equation:

$$11/14 \times N\ \% - 0.0004 \leqq B \leqq 11/14 \times N\ \% + 0.002$$

and the balance being Fe and inevitable impurities.

16. A method for making a soft cold-rolled steel sheet comprising:

(a) casting a steel consisting essentially of:

0.06 wt. % or less C, 0.1 wt. % or less Si, 0.5 wt. % or less Mn, 0.03 wt. % or less P, 0.02 wt. % or less S, 0.04 wt. % or less sol.Al, 0.006 wt. % or less N, said N satisfying the following equation: N wt. %≧S wt. %/5, B being within a range defined by the following equation:

$$11/14 \times N\ \% - 0.0004 \leqq B \leqq 11/14 \times N\ \% + 0.002$$

and the balance being Fe and inevitable impurities;

(b) hot-direct rolling the steel from (a) to produce a hot-rolled steel sheet, said hot-direct rolling being carried out with a finishing temperature of an $Ar_3$ point or more and coiling the hot-rolled steel at a coiling temperature of 650° C. or less;

(c) pickling the hot-rolled steel sheet from (b);

(d) cold-rolling the pickled hot-rolled steel sheet from (c) to produce a cold-rolled steel sheet; and (e) continuously annealing the cold-rolled steel sheet from (d) at a temperature of less than 800° C.

17. The method of claim 16, wherein said step (b) of hot-direct rolling comprises:

rough-rolling the steel at a finish temperature of 1000° C. or less to produce a rough-rolled steel sheet;

heating the rough-rolled steel sheet to a temperature of 1030° C. or more; and finish-rolling the heated steel sheet at a finish temperature of $Ar_3$ or more.

18. The soft cold-rolled steel sheet of claim 3, wherein said N is in an amount of 0.0035 wt. % or less.

19. The soft cold-rolled steel sheet of claim 9, wherein said aluminum oxide is in an amount of 10 ppm or less.

20. The method of claim 13, wherein said aluminum oxide is in an amount of 10 ppm or less.

* * * * *